US006808183B2

(12) United States Patent
Schaller et al.

(10) Patent No.: US 6,808,183 B2
(45) Date of Patent: Oct. 26, 2004

(54) BINDING MOUNTING METHOD AND APPARATUS

(75) Inventors: Hubert M. Schaller, Burlington, VT (US); G. Scott Barbieri, Middlebury, VT (US); Christian Breuer, Axams (AT)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 10/412,097

(22) Filed: Apr. 11, 2003

(65) Prior Publication Data

US 2003/0189316 A1 Oct. 9, 2003

Related U.S. Application Data

(63) Continuation of application No. 09/965,133, filed on Sep. 27, 2001, now abandoned.
(60) Provisional application No. 60/296,379, filed on Jun. 6, 2001.

(51) Int. Cl.[7] ..... B62B 13/00
(52) U.S. Cl. ..... 280/14.22; 280/618
(58) Field of Search ..... 280/14.21, 14.22, 280/617, 618, 607, 14.24; 441/70

(56) References Cited

U.S. PATENT DOCUMENTS

| | | | |
|---|---|---|---|
| 599,495 | A | 2/1898 | Durel et al. |
| 1,678,579 | A | 7/1928 | Vincent |

(List continued on next page.)

FOREIGN PATENT DOCUMENTS

| | | | |
|---|---|---|---|
| DE | 3603258 | | 10/1987 |
| DE | 2811096 | | 10/1989 |
| DE | 29921307 | U1 | 2/2000 |
| EP | 0396133 | B1 | 11/1990 |
| EP | 0398794 | A1 | 11/1990 |
| FR | 2592807 | | 7/1987 |
| FR | 2627097 | | 8/1989 |
| FR | 2704155 | | 10/1994 |
| FR | 2771644 | | 4/1999 |
| JP | 8-257201 | A2 | 10/1996 |
| JP | 11-206952 | A | 8/1999 |
| JP | 3067956 | | 2/2000 |
| JP | 2001-259107 | | 9/2001 |
| WO | 96/26773 | | 9/1996 |
| WO | 97/22391 | | 6/1997 |
| WO | 98/46314 | | 10/1998 |

OTHER PUBLICATIONS

IDS Appendix A with Figures 1–3 and description of Plastic Specialties.
K2 Snowboards Catalog, 1999–2000 Season, Carbon Pro Binding with holddown disk.
IDS Appendix B with Figures 1–3 and description of K2 hold down disk.
Translation of DE 3603258 to Burghaber Gunter published Oct. 22, 1987.
European Search Report EP02011627, dated Sep. 10, 2002.
Japanese Technical Evaluation Report for 3362/2002, dated Jul. 19, 2002.
Information Disclosure Statement Appendix.

*Primary Examiner*—Bryan Fischmann
(74) *Attorney, Agent, or Firm*—Wolf, Greenfield & Sacks, P.C.

(57) ABSTRACT

A method and system for mounting a binding to a gliding board. In one embodiment, a single row of attachment features, e.g., threaded inserts, may be used to mount a foot binding to the gliding board. The attachment features may be equally spaced along the row, e.g., at 25 mm increments. In one embodiment, a binding includes a hold down plate that may be attached to the gliding board using only two fasteners, e.g., each fastener engaging with an attachment feature on the board, or using only fasteners that lie along a longitudinal line on the gliding board.

11 Claims, 6 Drawing Sheets

U.S. PATENT DOCUMENTS

| | | | | |
|---|---|---|---|---|
| 2,130,693 | A | | 9/1938 | Nashe et al. |
| 2,740,972 | A | | 4/1956 | Talyor |
| 2,919,452 | A | | 1/1960 | Kluge |
| 3,049,734 | A | | 8/1962 | Johnson et al. |
| 3,172,678 | A | | 3/1965 | Beyl |
| 3,295,859 | A | | 1/1967 | Perry |
| 3,404,900 | A | | 10/1968 | Rippetoe |
| 3,446,511 | A | | 5/1969 | Marker |
| 3,731,945 | A | | 5/1973 | Johnson |
| 3,785,668 | A | | 1/1974 | Marker |
| 3,845,964 | A | | 11/1974 | Johnson |
| 4,040,137 | A | | 8/1977 | Fetherston et al. |
| 4,097,061 | A | | 6/1978 | Dietlein |
| 4,410,199 | A | | 10/1983 | Eisenberg |
| 4,718,873 | A | | 1/1988 | Shaw et al. |
| 4,871,337 | A | | 10/1989 | Harris |
| 4,973,073 | A | | 11/1990 | Raines et al. |
| 4,979,760 | A | | 12/1990 | Derrah |
| 5,021,017 | A | | 6/1991 | Ott |
| 5,035,443 | A | | 7/1991 | Kincheloe |
| 5,046,746 | A | | 9/1991 | Gierveld |
| 5,056,808 | A | | 10/1991 | Klaus et al. |
| 5,143,396 | A | | 9/1992 | Shaanon et al. |
| 5,147,234 | A | | 9/1992 | Brug |
| 5,172,924 | A | | 12/1992 | Barci |
| 5,236,216 | A | | 8/1993 | Ratzek |
| 5,261,689 | A | | 11/1993 | Carpenter et al. |
| 5,277,635 | A | | 1/1994 | Gillis |
| 5,417,443 | A | | 5/1995 | Blattner et al. |
| 5,433,636 | A | | 7/1995 | Gillis |
| 5,525,083 | A | | 6/1996 | Reich |
| 5,584,492 | A | | 12/1996 | Fardie |
| 5,673,927 | A | | 10/1997 | Vermillion |
| 5,765,854 | A | | 6/1998 | Moore et al. |
| 5,782,476 | A | | 7/1998 | Fardie |
| 5,826,910 | A | | 10/1998 | Ricks et al. |
| 5,839,747 | A | | 11/1998 | Gervasoni |
| 5,863,050 | A | | 1/1999 | Meader et al. |
| 5,868,416 | A | | 2/1999 | Fardie |
| 5,876,045 | A | | 3/1999 | Acuna, Jr. |
| 5,909,893 | A | | 6/1999 | Keller et al. |
| 5,941,552 | A | | 8/1999 | Beran |
| 5,947,508 | A | | 9/1999 | Graf et al. |
| 5,967,542 | A | | 10/1999 | Williams et al. |
| 6,007,085 | A | | 12/1999 | Rigal et al. |
| 6,015,161 | A | | 1/2000 | Carlson |
| 6,022,041 | A | | 2/2000 | Dailey et al. |
| 6,053,522 | A | | 4/2000 | Fogarty et al. |
| 6,109,991 | A | * | 8/2000 | McClaskey ..... 441/70 |
| 6,189,899 | B1 | | 2/2001 | Carlson |
| 6,189,911 | B1 | | 2/2001 | Caron et al. |
| 6,206,402 | B1 | | 3/2001 | Tanaka |
| 6,234,513 | B1 | | 5/2001 | Busby, Jr. et al. |
| 6,349,961 | B1 | | 2/2002 | Colley et al. |
| 2001/0030411 | A1 | | 10/2001 | Arnell et al. |
| 2003/0042709 | A1 | | 3/2003 | Dodge |

* cited by examiner

BINDING MOUNTING METHOD AND APPARATUS

RELATED APPLICATIONS

This application is a continuation of U.S. application Ser. No. 09/965,133, filed Sep. 27, 2001, now abandoned, which claims the benefit of the filing date under 35 U.S.C. §119 of U.S. Provisional Application No. 60/296,379, filed Jun. 6, 2001. application Ser. Nos. 09/965,133 and 60/296,379 are hereby incorporated by reference in their entirety.

FIELD OF THE INVENTION

This invention relates to binding mounting methods and apparatus, such as those used for snowboards, skis, snowshoes and other devices.

DESCRIPTION OF RELATED ART

During riding, a snowboard rider's foot is typically secured to the snowboard by a binding. The binding may be mounted to the snowboard in a variety of different ways, but typically is mounted using bolts or screws that engage with threaded metallic inserts that are fixed within the snowboard. Although different insert patterns have been proposed, inserts are usually fixed in snowboards in one of two different pattern types.

One type of pattern, commonly called a 4×4 ("four-by-four") pattern, includes inserts fixed in the snowboard along two longitudinal lines parallel to the longitudinal, or tip-to-tail, direction of the board. The inserts form one or more square patterns of inserts, with inserts located at the corners of each square pattern. A binding may be attached to the snowboard using a hold-down disk (discussed below) having four holes arranged to match one of the square patterns of inserts. Once the four holes in the hold down disk are aligned with one of the square patterns of inserts, screws may be inserted through the holes, engaged with the inserts and tightened to secure the disk and the binding to the snowboard. The binding may be adjusted in position along the tip-to-tail direction by reattaching the disk to the snowboard using a different square pattern of inserts.

A second insert pattern, commonly called the 3D® hole pattern, is provided on snowboards from Burton Snowboards and includes inserts arranged to form a plurality of equilateral triangle patterns. Each equilateral triangle pattern has inserts located at the vertices of the triangle and has one side parallel to a lateral direction, or edge-to-edge direction, on the board. A binding may be secured to a snowboard using a hold down disk that has three holes at the vertices of an equilateral triangle. The holes may be aligned with one of the triangular patterns of inserts, and screws may be inserted through the holes to secure the disk to the snowboard. An example of the 3D® pattern is shown in U.S. Pat. No. 5,261,689 to Carpenter et al.

Inserts in a snowboard may increase the weight and cost of the snowboard, while decreasing the strength of the board. For example, an insert may weigh more than the portion of the board that is replaced by the insert, and/or the board may require reinforcement, e.g., additional fiberglass and/or a stronger core material, in the vicinity of each insert to prevent board failure or insert pull-out. Therefore, minimizing the number of inserts in a snowboard while maintaining a same or improved range of binding adjustment (i.e., a total length along the board over which a binding may be mounted) and increment of adjustment (i.e., distance between adjacent mounting positions) is generally desirable.

SUMMARY OF THE INVENTION

In one illustrative embodiment in accordance with the invention, a majority of attachment features on a board may be arranged along one row generally extending in the tip-to-tail direction of the board. For example, the board may have all or substantially all inserts used to mount a binding to the board arranged along a single row parallel to the board centerline. Binding mounting positions may be provided by patterns of two or three attachment features. For example, all of the attachment features may be arranged along one row and binding mounting positions provided by pairs or other groups of features in the row. Alternately, attachment features may be arranged along two rows, with a majority of the features arranged in one of the rows. Binding mounting positions may be provided by triangular patterns of features, e.g., two features in one row and a third in the other row. Thus, the number of attachment features needed for a given number of binding mounting positions may be reduced and/or the number of binding mounting positions provided by a given number of attachment features may be increased compared to other attachment feature arrangements. In addition, concentrating attachment features along one row may allow reinforcement of the board intended to prevent feature pull-out or other detachment to be concentrated along a more narrow portion of the board, potentially decreasing the weight and/or cost of the board.

In another illustrative embodiment of the invention, attachment features are arranged on a gliding board along a longitudinal row to form a plurality of linear mounting patterns for a binding. Each mounting pattern is formed by two attachment features on the longitudinal row. The attachment features may be equally spaced from each other, e.g., at 25 mm increments, and arranged along or near the board longitudinal centerline.

In another aspect of the invention, a method of attaching a binding to a snowboard includes providing a snowboard having a plurality of attachment features fixed in a row in the snowboard, and providing a hold down disk having two openings adapted to cooperate with pairs of the attachment features. The hold down disk is attached to the snowboard using only a pair of the attachment features, and/or using only attachment features that lie along the row. As used herein, the term "providing" is intended to include any manner of obtaining, using, handling, or otherwise securing possession of an object whether through purchase, loan, manufacture, etc. Thus, for example, a technician hired or otherwise employed to attach a binding to a snowboard "provides" the snowboard and binding as the term is used herein even though the snowboard and binding may have been manufactured by and/or is owned by a person or entity other than the technician.

In another aspect of the invention, an apparatus includes a gliding board, such as a snowboard having a tip and a tail, metal edges and a base suitable for gliding on a snow surface, and at least three attachment features to attach a binding to the snowboard. The attachment features may be arranged in at least one attachment feature pattern and along at least one row on the snowboard, the at least one row extending in the tip-to-tail direction of the snowboard. The apparatus may also include a snowboard binding hold down disk having a tip-to-tail axis adapted to extend in a tip-to-tail direction on the snowboard when the hold down disk is mounted to the snowboard. The hold down disk may have openings adapted to cooperate with an attachment feature pattern including no more than three attachment features arranged on the snowboard in no more than one or two rows to mount the hold down disk to the snowboard.

In another illustrative embodiment in accordance with an aspect of the invention, the centers of attachment features that provide a plurality of binding mounting positions are located within a rectangular area on the board having a width of no more than 38 mm. In another aspect of the invention, the centers of the attachment features may be located within no more than 19 mm of the gliding board centerline. In one illustrative embodiment in accordance with these aspects of the invention, the attachment features may be arranged along two longitudinal rows that extend within 19 mm of the board centerline. In another illustrative embodiment, the attachment features may be arranged along a single row that is parallel to the board centerline.

In another aspect of the invention, a gliding board includes a plurality of attachment features arranged in a plurality of patterns to provide at least three adjacent binding mounting positions. The attachment features are arranged so that when a hold down disk is mounted to the board using one of the attachment feature patterns, no more than three attachment features are covered by the hold down disk. In another aspect of the invention, exactly three attachment feature are covered by the disk. This feature can be provided by attachment feature patterns including two or three features and by arrangements of attachment features along one or two rows. This is in contrast to a conventional 3D or 4×4 pattern that provides three or more adjacent mounting positions and has four inserts covered by a hold down disk when the disk is mounted to the board.

In another aspect of the invention, a snowboard having a tip, a tail and metal edges may have a plurality of attachment features fixed to the snowboard and adapted to cooperate with a hold down disk to attach a binding to the snowboard. The plurality of attachment features may be arranged on the snowboard to provide at least three binding mounting positions for the hold down disk on the snowboard including a first mounting position, a second mounting position adjacent the first mounting position, and a third mounting position adjacent the second mounting position, wherein the first and third mounting positions share one attachment feature.

In another aspect of the invention, a gliding board, such as a snowboard, includes a plurality of attachment features to attach a binding to the board. The attachment features are arranged on the board to form at least three adjacent binding mounting positions. The binding mounting positions are provided by patterns of attachment features such that only one attachment feature from attachment feature patterns for each of any two adjacent binding mounting positions is not shared.

One illustrative embodiment in accordance with the invention includes a gliding board having a tip and a tail, and a plurality of attachment features to attach a binding to the gliding board. The attachment features are arranged along first and second rows extending in the tip to tail direction of the gliding board so that a first attachment feature in the first row, a second attachment feature in the second row, and a third attachment feature in the first row are at the vertices of at least one equilateral triangle. This triangular pattern of attachment features may be used to attach the binding, such as a strap-type foot binding, to the gliding board.

In another illustrative embodiment, attachment features are arranged on a gliding board having a tip and a tail and a tip-to-tail direction extending therebetween. The attachment features are evenly spaced only along first and second rows that generally extend in the tip to tail direction of the gliding board. The first and second rows are longitudinally offset so that no attachment feature in the first row lies on a same lateral line, perpendicular to the rows, as an attachment feature in the second row.

In another illustrative embodiment, attachment features to attach a binding to the gliding board are arranged on the gliding board to provide at least two binding mounting positions spaced apart along the length of the board. The increment of adjustment along the length of the board between the two binding mounting positions is less than a minimum distance between any two of the plurality of attachment features that provide the at least two binding mounting positions.

In another illustrative embodiment, attachment features to attach a binding to the gliding board are arranged so that at least one of the plurality of attachment features is equally spaced from four adjacent attachment features.

In another illustrative embodiment, attachment features to attach a binding to the gliding board are arranged to form at least one non-right triangular pattern of adjacent attachment features. The at least one non-right triangular pattern provides a binding mounting position, and each attachment feature is positioned at a vertex of the at least one non-right triangle. One leg of the non-right triangle extends substantially parallel to a tip-to-tail direction on the gliding board.

In another illustrative embodiment, attachment features are arranged on the gliding board to form at least one equilateral triangular pattern of attachment features that provides a binding mounting position and has no leg parallel to an edge-to-edge direction on the gliding board.

In another illustrative embodiment, attachment features are arranged on the gliding board to form a plurality of adjacent binding mounting patterns each having a center. In this embodiment, the centers of adjacent binding mounting patterns are offset on alternate sides of a line extending in a tip-to-tail direction on the board.

In another illustrative embodiment, attachment features are arranged on a snowboard along first and second longitudinal rows to form a plurality of equilateral triangular patterns of attachment features. The first and second longitudinal rows are parallel to a tip-to-tail direction on the snowboard, and each equilateral triangular pattern provides a binding mounting position formed by a first attachment feature on one of the first and second rows and second and third attachment features adjacent the first attachment feature on the other of the first and second rows. A pair of snowboard bindings are attached to the snowboard with each binding attached to the snowboard via one of the plurality of equilateral triangular patterns of attachment features.

In another aspect of the invention, the number of binding mounting positions that is provided by plurality of attachment features on a board is equal to two less than the number of attachment features. For example, if a set of attachment features that provide a plurality of binding mounting positions has a total of five attachment features, the set of attachment features may provide three binding mounting positions (5 features−2=3 mounting positions). Such a relationship between the number of attachment features and the number of binding mounting positions may be present in attachment feature patterns that include two or three attachment features and in which attachment features are arranged along one or two rows. This is in contrast to 4×4 patterns, e.g., a 4×4 pattern that provides three binding mounting positions includes six attachment features, and 3D patterns, e.g., a 3D pattern that provides three binding mounting positions includes at least six and likely seven attachment features.

A snowboard binding hold down disk in accordance with the invention has a center and a tip-to-tail axis adapted to extend in a tip-to-tail direction on a snowboard when the hold down disk is mounted to the snowboard. The hold down disk has at least three openings that form a triangle and are adapted to cooperate with attachment features arranged on the snowboard. The at least three openings are arranged so that no leg of the triangle is perpendicular to the tip-to-tail axis.

In another illustrative embodiment, a snowboard binding hold down disk has at least three openings that form a triangle and are adapted to cooperate with attachment features arranged on the snowboard. The at least three openings are arranged in the disk so that a leg extending parallel to the tip-to-tail axis is as long as any other leg of the triangle.

In another illustrative embodiment, a snowboard binding hold down disk has at least three openings that form an equilateral triangle and are adapted to cooperate with attachment features arranged on the snowboard. The equilateral triangle has a leg that is parallel to the tip-to-tail axis.

In another illustrative embodiment, a snowboard binding hold down disk has at least three openings that form at least one triangle and are adapted to cooperate with attachment features arranged on the snowboard. The at least one triangle includes at least one central triangle, and the center of the at least one central triangle is offset from the center of the hold down disk.

BRIEF DESCRIPTION OF THE DRAWINGS

Illustrative embodiments in accordance with aspects of the invention are described in connection with the following drawings, in which like numerals reference like elements, and wherein.

DETAILED DESCRIPTION

Figure 1:
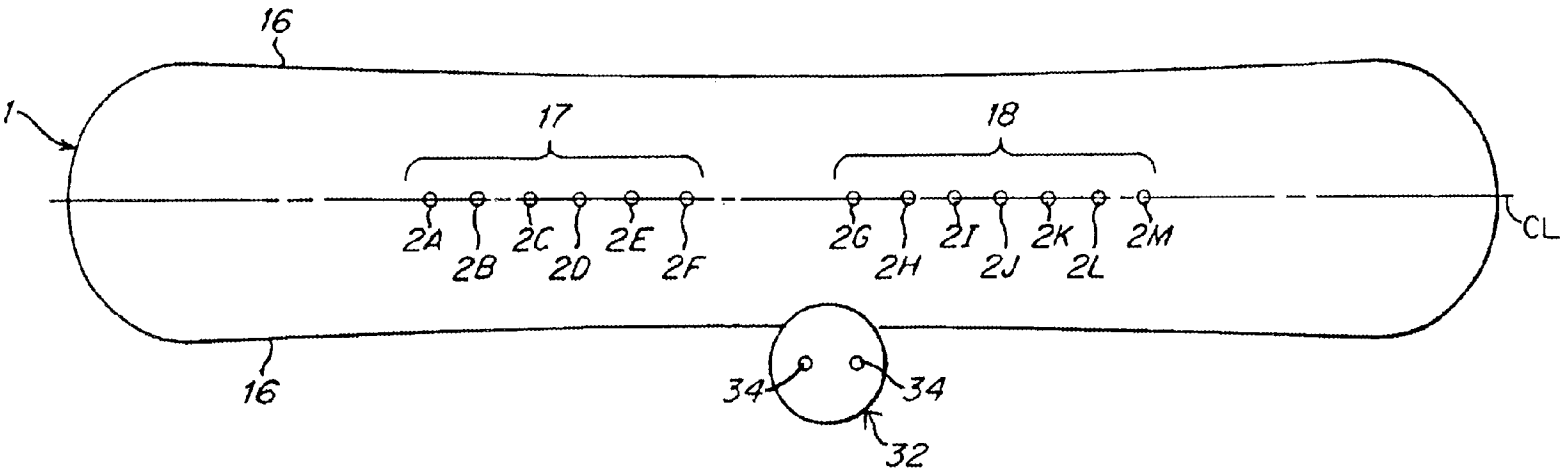
FIG. 1 is a top view of a snowboard having an attachment feature pattern according to one embodiment of the invention and a compatible hold down disk.

In one aspect of the invention, a plurality of attachment features (e.g., metallic inserts) is arranged on a gliding board, such as a snowboard, so that an additional binding mounting position can be added in all cases when a single additional attachment feature is appropriately added to the board. This can be accomplished in multiple ways. For example, in one embodiment for use with a binding that is attached to the board via only two fasteners, the attachment features may be arranged in a single row along the centerline of the snowboard. Pairs of attachment features in the row may each provide a binding mounting position, and the addition of one attachment feature to either end of the row may add another binding mounting position. This is in contrast to conventional snowboards. For example, with the 4×4 pattern, two attachment features must be added to add another binding mounting position. With the 3D® pattern, another binding mounting position may be added at certain positions in the pattern by adding a single attachment feature, but not in all positions in the pattern. For example, with a 3D® pattern that includes eight attachment features, at least two attachment features must be added to provide another binding mounting position on either end of the pattern.

In another illustrative embodiment for use with a binding that is attached to the board with three fasteners, attachment features may be arranged along two rows in the board with binding mounting positions provided by triangular patterns of attachment features such that two attachment features in each pattern are positioned in a first row and a third attachment feature in the pattern is positioned in the other row. The rows of attachment features are offset so that the addition of one attachment feature to the end of one of the rows adds another binding mounting position. Thus, additional binding mounting positions may be added with the addition of a fewer number of attachment features than with conventional hole patterns, e.g., the addition of one attachment feature may add one binding mounting position.

In another aspect of the invention, non-adjacent binding mounting positions may share at least one attachment feature. This is in contrast, for example, to 4×4 and 3D patterns in which adjacent binding mounting positions share attachment features, but non-adjacent binding mounting positions do not share attachment features. By having non-adjacent binding mounting positions share at least one attachment feature, more efficient use of attachment features in the board may be made. In one illustrative embodiment for use with a binding that is attached via two fasteners, attachment features may be arranged in a single row with the attachment features equally spaced from each other along the row. Binding mounting positions may be provided by attachment feature patterns that include two attachment features along the row that are separated from each other by one attachment feature. In another illustrative embodiment for use with a binding that is attached via three fasteners, attachment features may be arranged along two rows so that binding mounting positions are provided by triangular patterns of attachment features. Non-adjacent binding mounting positions may share one attachment feature, e.g., first and third binding mounting positions that are adjacent to a second mounting position located between the first and third binding mounting positions may share one attachment feature. Also, in certain embodiments, first, second and third binding mounting positions may share one attachment feature.

FIG. 1 is a top view of an illustrative embodiment of a snowboard 1 that incorporates several of the aspects of the invention described above. A variety of different illustrative embodiments are described herein that incorporate various different aspects of the invention. Aspects of the invention are not limited to the illustrative embodiments described below.

The snowboard 1 shown in FIG. 1 has a plurality of attachment features 2 that may be used to attach a snowboard binding or other mounting device (not shown) to the snowboard 1. The attachment features 2 may be any feature compatible with a corresponding mating feature for mounting a binding to the snowboard 1, as the invention is not limited to any particular type of attachment feature. For example, the attachment features 2 may be threaded plastic or metallic inserts or studs fixed within holes formed in the snowboard 1 using any suitable technique, a metal or plastic plate attached to the snowboard 1 having threaded or non-threaded studs or holes in the plate, or any other suitable feature. In some embodiments, the attachment features 2 are separate from other attachment features, as is the case with individual metallic inserts commonly used in snowboards. In other embodiments, the attachment features 2 may be connected together, such as when a plurality of metallic inserts are integrally formed from a single plate or otherwise attached together to form a unit that is mounted within a snowboard. The attachment features 2 may be fixed on the snowboard 1, e.g., metallic inserts may be molded or otherwise secured within the board.

In the illustrative embodiment shown in FIG. 1, the attachment features 2 are arranged on the snowboard 1 in two groups 17 and 18, each group for mounting a different binding to the snowboard 1. A first group 17 includes the attachment features 2A through 2F, and the second group 18 includes the attachment features 2G through 2M. As an example, the first group 17 may be used to attach a left foot binding (bindings not shown in FIG. 1) to the snowboard 1, and the second group 18 may be used to attach a right foot binding to the snowboard 1. The attachment features 2 are arranged so that suitable groups of attachment features 2 form attachment feature patterns that each provides a binding mounting position. The attachment feature patterns may have any suitable configuration. For example, an attachment feature pattern may be formed by the attachment feature pairs 2A and 2B, 2B and 2C, and so on. In this case in accordance with an aspect of the invention, adjacent attachment feature patterns, e.g., the pattern with features 2A and 2B and the pattern with features 2B and 2C, share one attachment feature, and only one attachment feature in the adjacent patterns is not shared. Alternately, attachment feature patterns may be formed by other groupings of attachment features, such as patterns formed by alternate attachment features 2A and 2C, 2B and 2D, 2C and 2E, and so on. In this case in accordance with one aspect of the invention, adjacent attachment feature patterns, e.g., patterns including features 2A and 2C and 2B and 2D, do not share any attachment feature. Another aspect of the invention illustrated by this type of attachment feature pattern is that non-adjacent attachment feature patterns, e.g., patterns including features 2A and 2C and 2C and 2E, may share at least one attachment feature, e.g., feature 2C. In another embodiment, groups of three adjacent attachment features, e.g., features 2A, 2B and 2C, may provide a binding mounting position.

Each left and right foot binding may, for example, be mounted via a hold down disk 32 or otherwise to the snowboard 1 at a selected mounting position with holes 34 arranged to cooperate with patterns of attachment features 2 on the board 1. A width of a rider's stance on the snowboard 1 may be adjusted, e.g., narrowed or widened, by adjusting the mounting position of either or both the left and right foot bindings using different patterns of attachment features 2 to secure the bindings to the snowboard 1.

In the illustrative embodiment of FIG. 1, the hold down disk 32 includes two holes 34 that are adapted to cooperate with patterns of two attachment features 2 that are arranged so that a third attachment feature is positioned between the two features in the pattern. For example, as shown in FIG. 1, the holes 34 in the hold down disk 32 may cooperate with the pattern including attachment features 2A and 2C, which has the attachment feature 2B positioned between the features 2A and 2C. Of course, the holes 34 may be arranged in any suitable way, e.g., to cooperate with pairs of adjacent features (2A and 2B) or sets of three attachment features (2A, 2B and 2C).

One aspect of the invention illustrated in FIG. 1 is that when the hold down disk 32 is mounted to the board 1 by an attachment feature pattern, such as features 2A and 2C, three attachment features are covered by the disk 32, i.e., features 2A, 2B and 2C. By "covered", it is meant that the attachment features 2 are completely covered over by a bottom portion of the disk 32 that is in contact with, or positioned near, the board top surface when mounted to the board. In one illustrative embodiment of the invention, the disk 32 has a diameter of approximately 100 millimeters and the attachment features 2 are spaced at 25 millimeters from each other along the row, e.g., feature 2B is spaced 25 mm from both features 2A and 2C, feature 2D is spaced 25 mm from both features 2C and 2E, and so on. Thus, the holes 34 in the disk 32 may be positioned so that only three attachment features 2 are covered by the disk 32 when mounted to the board, e.g., the holes 34 may be positioned 50 millimeters apart along a diametric line of the disk 32 at approximately 25 mm from the outer periphery of the disk 32. The disk may have a frustoconical or stepped shape such that the disk 32 has a maximum diameter of approximately 100 millimeters at a wider, upper portion of the disk 32 normally positioned away from the board 1, and a diameter of approximately 85 millimeters at a smaller, bottom portion of the disk 32 that normally contacts the board top surface when mounted to the board 1. In this case, the holes 34 may be positioned approximately 50 millimeters apart along a diametric line on the disk 32 so that one of the holes 34 is positioned about 17.5 millimeters from the center of the disk 32 and the other hole 34 is positioned about 32.5 millimeters from the center of the disk 32. With such an arrangement, the disk 32, i.e., the smaller, bottom portion of the disk 32, will not cover more than three attachment features 2 when mounted to the board having attachment features 2 spaced at 25 millimeters.

It should be appreciated that with the FIG. 1 embodiment, an additional mounting position may be added to the board 1 with the addition of a single attachment feature 2 to the board 1 for all positions in the pattern. For example, an attachment feature 2 may be added to either end of the row of features 2 in the first group 17 to add another binding mounting position, e.g., a feature 2 may be added to the right of attachment feature 2F and arranged to cooperate with the feature 2E to form another attachment feature pattern. This can make efficient use of attachment features 2 since a minimum number of attachment features may be added to provide additional mounting positions.

Another aspect of the invention illustrated in FIG. 1 is that a majority of the attachment features 2 are arranged along a first row on the board 1. In fact, in this embodiment, all of the attachment features used to mount a binding to the board are arranged along a first row that is colinear with the board centerline CL. Other aspects of the invention illustrated are that centers of the attachment features 2 are located within 19 millimeters of the board centerline CL, and the attachment features 2 are positioned within a rectangular area having a width (e.g., a dimension measured perpendicular to the centerline CL) that is no more than 38 millimeters. These aspects of the invention allow closer spacing of the attachment features 2 to a single line along the board 1, allowing reinforcement of the board to be concentrated in a more narrow zone that that possible with other attachment feature arrangements. For example, the single row of attachment features in FIG. 1 permits the use of a relatively narrow hardwood strip or other board reinforcement in a more narrow area near the centerline CL as compared to other arrangements such as 4×4 and 3D. It should be appreciated that this aspect of the invention is not limited to having attachment features positioned along a single row colinear with or parallel to the centerline CL. Instead, attachment features may be positioned in any suitable way within 19 mm or less of the centerline, or within a rectangular area having a width of no more than 38 millimeters. The rectangular area may be aligned along the centerline CL or transverse to the centerline CL. The centerline CL is an imaginary line that extends in a longitudinal, or tip-to-tail, direction of the snowboard 1 and is equally spaced from the edges 16 of the board.

In another aspect of the invention, the arrangement of attachment features 2 shown in FIG. 1 also provides an overall range of adjustment, i.e., a total distance over which a binding may be mounted to a snowboard 1, that is greater than 4×4 and 3D® patterns having a same number of attachment features. For example, a 4×4 pattern that provides a same number of mounting positions and total range of adjustment as a pattern shown in FIG. 1 would necessarily require more attachment features 2, since four attachment features 2 are used to mount a binding at each mounting position and two additional attachment features 2 must be added to the pattern for each new mounting position. Reducing the number of attachment features 2 in the snowboard 1 may allow for a lower weight board and/or require less reinforcement of the board near the attachment features 2 to prevent pull-out or other detachment of the features 2 from the snowboard 1.

The first group 17 of attachment features 2 in FIG. 1 includes six attachment features 2, whereas the second group 18 includes seven attachment features 2. However, it should be understood that the first and second groups of attachment features 2 each may include any suitable number of attachment features 2 other than six or seven attachment features 2, e.g., to provide a different range of adjustment for a binding, as the invention is not limited to using any particular number of attachment features 2. In addition, the first and second groups 17 and 18 of attachment features 2 may include a same number of attachment features 2, e.g., six inserts.

In the illustrative embodiment of FIG. 1, the attachment features 2 are arranged along the centerline CL. However, this arrangement is not necessary. For example, a first group 17 of attachment features 2 may be arranged along a first row, and a second group 18 of attachment features 2 may be arranged along a second row. The first and second rows may or may not be parallel to or colinear with each other and/or the centerline CL. Thus, first and second groups 17 and 18 of attachment features 2 may be arranged along lines that are at an angle with respect to each other and/or at an angle with respect to the centerline CL. Further, the snowboard 1 need not include two distinct groups 17 and 18 of attachment features 2, but instead may have a single continuous group of equally spaced attachment features 2.

The snowboard 1 or other gliding board may be manufactured in any suitable way using any suitable materials. For example, the snowboard 1 may be a side wall-type board having a wood core positioned between upper and lower layers of fiber-reinforced material (e.g., fiberglass), and may include a plastic base material and metal side edges. The snowboard 1 may also be a cap-type snowboard, or may be formed from other materials, as the invention is not limited in the manner in which the snowboard 1 is constructed, the shape of the snowboard 1, or materials included in the snowboard 1.

Figure 2:
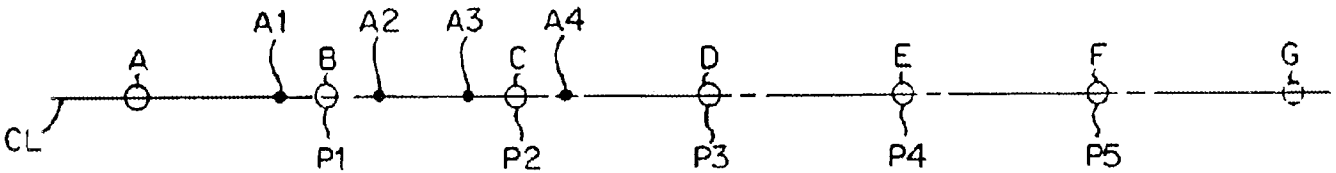
FIG. 2 is a geometrical representation of a portion of the attachment feature pattern in the embodiment shown in FIG. 1.

FIG. 2 shows a more detailed geometrical representation of the first group 17 of attachment features 2 in a specific illustrative embodiment of FIG. 1. In this illustrative embodiment, attachment features 2 are positioned at or near each of the points A–F, which are arranged in a single row. In this illustrative embodiment, the points A–F are separated by 25 millimeters from a nearest, adjacent point, and pairs of points separated by a single point provide a binding mounting position for a binding. For example, points A and C provide a binding mounting position P1, points B and D provide a binding mounting position P2, and so on. As used herein, a binding mounting position is a point along the centerline CL or other longitudinal reference line on the board 1 that lies on the same lateral line as a centerpoint of an attachment feature pattern, i.e., the pattern centerpoint is equidistant from attachment features in the pattern that provide the binding mounting position. Thus, in this illustrative embodiment, the binding mounting position P1 is positioned at the centerline CL equidistantly from points A and C. An increment of adjustment between binding mounting positions, i.e., the distance between adjacent mounting positions, in this illustrative embodiment is equal to the minimum spacing between attachment features.

Another aspect of the present invention illustrated by the attachment feature pattern shown in FIG. 2 is that an additional binding mounting position P may be added to all positions in the pattern by adding a single additional attachment feature 2. For example, by adding an attachment feature at the point G in FIG. 2, an additional binding mounting position P5 is added. This is not the case with 4×4 and 3D® patterns. In the case of the 4×4 pattern, four inserts are used to mount a binding at a mounting position, so that two additional inserts must be added to an existing pattern to provide an additional mounting position. In the case of the 3D® pattern, while in some cases an additional binding mounting position may be added by providing a single additional insert, this is not true for all positions in the pattern. That is, in some positions in the pattern, two additional inserts must be added to provide an additional mounting position.

It should also be understood that the aspect of the invention where only one attachment feature may be added to provide an additional mounting position is not limited to the specific pattern shown in FIG. 2, as other attachment feature patterns can be used that achieve this result.

In another aspect of the invention, the number of binding mounting positions P provided by the attachment features is equal to two less than the number of attachment features. In FIG. 2, six total attachment features at points A–F may provide four binding mounting positions P1–P4. Since an additional binding mounting position may be added with each addition of an attachment feature, the relationship of the number of binding mounting positions to total number of attachment features will remain the same. This is the case, for example, if an attachment feature is provided at point G, whereby the mounting position P5 is added.

Figure 3:
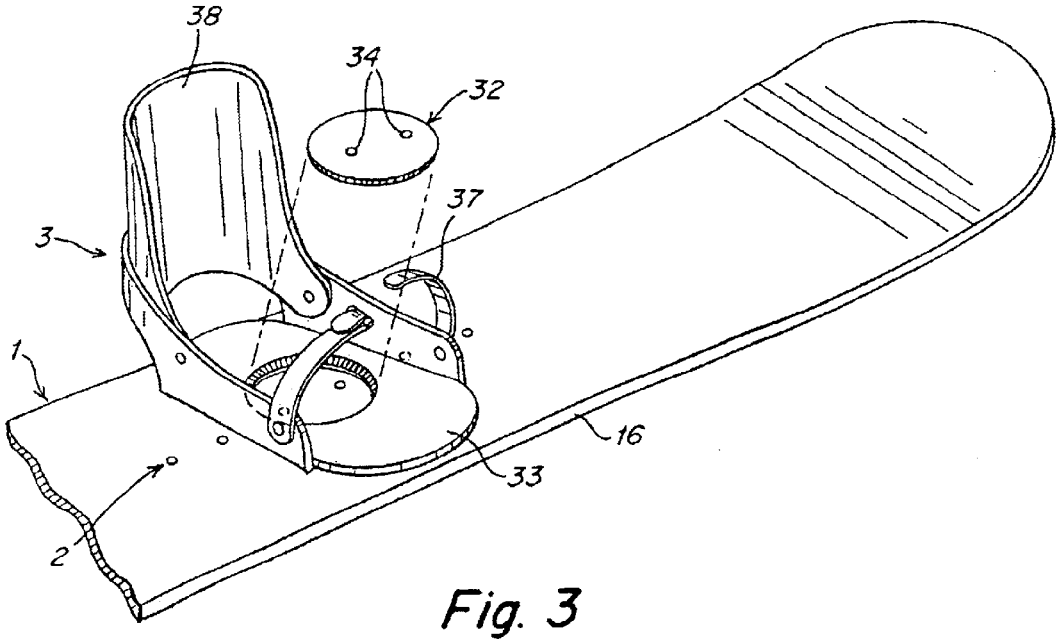
FIG. 3 is a perspective view of a binding mounted, using a hold down disk, to a snowboard with the attachment feature pattern of FIG. 1.

As discussed above, a binding 3 may be attached to the snowboard 1 as shown in FIG. 3 using a hold down disk 32 that has holes 34 arranged to overlie attachment features 2 in the snowboard 1. In FIG. 3, the binding 3 is shown as a conventional tray binding with a toe strap 37 and highback 38, but the present invention is not limited to a binding 3 including these and/or any other particular elements, as the binding 3 may be any type of binding, such as a strap binding, step-in binding, plate binding, or any other type of device used to attach a rider's foot to a snowboard 1, whether the rider is wearing soft or hard snowboard boots, or other footwear, as the invention is not limited to use with any particular type of binding 3. In contrast to other types of bindings, such as water ski bindings, the binding 3 may be a non-safety release binding such that once a rider's foot is secured in the binding, the foot is not released from the binding unless the straps or other securements are released. In typical water ski and snow ski bindings, for example, a rider/skier's foot may be removed from the binding, e.g., during a fall.

When mounting the binding 3 to the snowboard 1, holes 34 in the hold down disk 32 may be aligned with corresponding attachment features 2 at a suitable mounting position, and the disk 32 secured to the snowboard 1 at the mounting position, e.g., by engaging screws with the attachment features 2. The hold down disk 32 may engage with an opening formed in the baseplate 33 of the binding 3. The hold down disk 32 may have any suitable features to engage with the opening in the baseplate 33 to secure the binding 3 to the snowboard 1 and/or prevent rotation of the baseplate 33 relative to the hold down disk. For example, although the invention is not limited to such an arrangement, the hold down disk 32 may have a frusto-conical portion having teeth on its undersurface that engage with corresponding teeth formed in the baseplate 33 near the opening as described in U.S. Pat. No. 5,261,689. The holes 34 in the hold-down disk 32 may be arranged to provide a plurality of adjustment positions, e.g., to allow adjustment of the binding 3 in the edge-to-edge direction. Such an arrangement may provide more than one location for a binding to be mounted to the board using the same attachment features in the board. The hold down disk 32 may have hole patterns to accommodate attachment feature patterns in addition to those of the present invention discussed above (e.g., the 4×4 and/or 3D® pattern). Thus, the hold down disk 32 may be a so-called universal disk that provides for attachment of the disk 32 using two or more different attachment feature 2 patterns.

Figure 4:
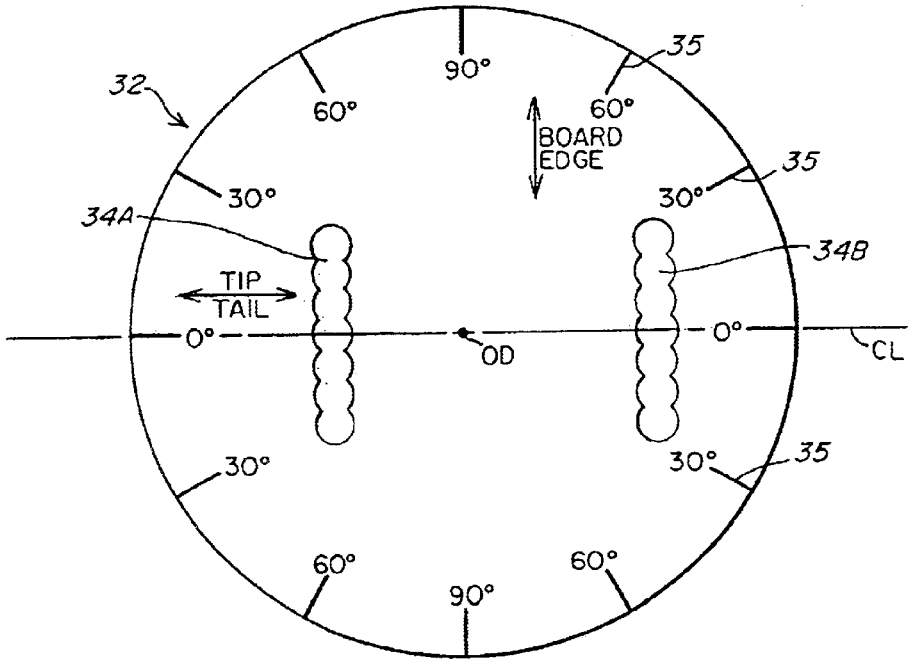
FIG. 4 is a top view of a hold down disk according to one embodiment of the invention that may, for example, be used with the attachment feature pattern shown in FIG. 1.

FIG. 4 shows one illustrative embodiment of a hold down disk 32 in accordance with another aspect of the invention. The hold down disk 32 is specially adapted for use with the attachment feature patterns discussed above in connection with FIGS. 1 and 2 and has two through holes 34 to receive fasteners (e.g., screws) to attach to the attachment features 2. In this illustrative embodiment, each hole 34 has scalloped portions to provide seven different adjustment positions, e.g., so that the hold down disk 32 and corresponding binding 3 may be adjusted in position in an edge-to-edge, or lateral, direction on the snowboard 1. That is, in this embodiment, each hole 34 provides for seven different lateral adjustment positions (e.g., spaced at 5 millimeter increments) at which a screw may pass through the hole 34 and secure the disk 32 to the snowboard 1. Sufficient holes 34 may be provided to provide a range of edge-to-edge, or lateral, adjustment that is at least 25 mm, 30 mm, 35 mm, 40 mm or more. Such ranges of adjustment may be provided with a hold down disk 32 that has a diameter of approximately 100 mm. This is in contrast to 4×4 or 3D pattern hold down disks in which a maximum of approximately 20 mm lateral adjustment is provided. These disks tend to be limited in the range of lateral adjustment provided because the 4×4 and 3D patterns force the holes in the disk to be positioned near the outer periphery of the disk. Since the holes are positioned near the periphery, the range of holes is typically limited so as to avoid weakening the disk and/or forming the holes too close to the periphery. Of course, the aspects of the invention directed to a new hold down disk 32 are not limited to one using holes 34 with six or seven scalloped adjustment positions, as each hole 34 may provide only a single adjustment position, may be replaced by multiple spaced holes each providing a single adjustment position, may be formed as an oblong hole not having any discrete adjustment positions, or may include different numbers of adjustment positions. Thus, in another aspect of the invention, the disk 32 may include two parallel rows of spaced holes, i.e., the slot holes 34 in FIG. 4 may be replaced with separate, distinct holes at any suitable spacing. One set of the holes may be adapted to locate the center of the disk at the board centerline CL.

One aspect of the invention illustrated in FIG. 4 is at least two elongated slot holes 34 in the disk 32 intersect the tip-to-tail axis of the disk 32. This is not the case in typical 3D and 4×4 disks in which two or more slots adapted to cooperate with attachment feature patterns to mount the disk do not intersect the tip-to-tail axis of the disk. The tip-to-tail axis of the disk is an imaginary line on the disk that passes through the disk center and is oriented parallel to the board centerline CL when the disk 32 is mounted to the board 1. In the illustrative embodiment of FIG. 4, the holes 34 are perpendicular to the tip-tail axis. The holes may be arranged in any suitable way, e.g., to cooperate with attachment feature patterns including two attachment features spaced 50 mm or any other suitable distance from each other in a row. Likewise, the disk 32 may have three holes 34 so that the disk may be mounted to the board by a linear pattern of three attachment features 2. In this case, three slot holes 34 may intersect the tip-tail axis.

Another aspect of the invention illustrated in FIG. 4 is that the slot holes 34 are adapted to cooperate with an attachment feature pattern so that the hold down disk may be attached to the board in first and second different orientations using the same attachment feature pattern on the snowboard and the same slot openings in the hold down disk, while still providing for adjustment of the hold down disk in a direction transverse to the tip-to-tail direction, e.g., in the lateral direction. This lateral adjustment may be made without altering the position of the hold down disk in the tip-to-tail direction. The difference between the first and second orientations may be a 180 rotation of the disk relative to the board, and may result in positioning the center of the disk in at a different position along the centerline CL. In this illustrative embodiment, the hole 34A is positioned approximately 18.75 mm from the center OD of the disk, and the hole 34B is positioned approximately 31.25 mm from the center OD. Since the holes 34A and 34B are separated by about 50 mm, the midpoint between the holes is offset from the disk center OD by about 6.25 mm. Thus, for example, if the disk 32 is mounted to the attachment features 2A and 2C in FIG. 2 in the orientation shown in FIG. 4, the center OD of the disk is positioned at longitudinal adjustment position A1 shown in FIG. 2. Position A1 is about 6.25 mm to the left of the binding mounting position P1. If the disk 32 is then rotated 180 degrees and mounted via the attachment features 2A and 2C, the center OD will be positioned at the longitudinal adjustment position A2, about 6.25 mm to the right of binding mounting position P1. If the disk 32 is then rotated 180 degrees and mounted via the attachment features 2B and 2D, the center OD will be positioned at the longitudinal adjustment position A3, about 12.5 mm to the right of position A2 and 6.25 mm to the left of binding mounting position P2. Accordingly, by offsetting the holes 34 in the disk 32, longitudinal adjustment positions for the disk 32 may be provided based on the orientation of the disk relative to the board. Of course, holes 34 in the disk 32 may be arranged in any suitable way relative to the center of the disk 32.

In the embodiment shown in FIG. 4, the disk 32 includes reference features, including angle indication marks 35, to provide an indication of the orientation of the binding 3 relative to the snowboard 1 or the disk 32. In FIG. 4, the angle indication marks 35 are in increments of 30° with the 0°, 30°, 60° and 90° marks being labeled. The angle indication marks 35 may be provided at a finer or more coarse scale and/or may also provide additional angle indication marks, such as one for the 45° mark. Also, the angle indication marks may be positioned in any suitable way on the disk 32, e.g., the 0° marks may be changed to 90° marks and the other marks 35 adjusted accordingly. The disk 32 may also include indicators showing the tip-to-tail direction, e.g., such as a double-headed arrow and text indicator extending between the tip-and-tail marks (e.g., the 0°—0° marks), and/or an indicator showing the approximate location of the edges 16 of the snowboard 1. These additional indicators may provide an aid to properly positioning the disk 32 on a snowboard 1. The angle indication marks 35 may be formed permanently in the disk 32, such as by molding the marks 35 in the disk 32, or may be applied to the disk 32, e.g., on a sticker or other label adhered to the disk 32. The invention is not limited to these specific marking features, as any suitable indication indicia will do. In addition, the angle indication marks 35 or other indicators on the disk 32 may be omitted from some embodiments.

As described above, various aspects of the invention may be implemented in a variety of different ways. The embodiments described above incorporate aspects of the invention and generally include attachment features (for one binding) arranged along a single row. Such an arrangement of the attachment features is not required for many aspects of the invention. For example, several aspects of the invention described above are incorporated into an alternate embodiment shown in FIG. 5. The FIG. 5 embodiment also illustrates several other aspects of the invention as described below.

Figure 5:
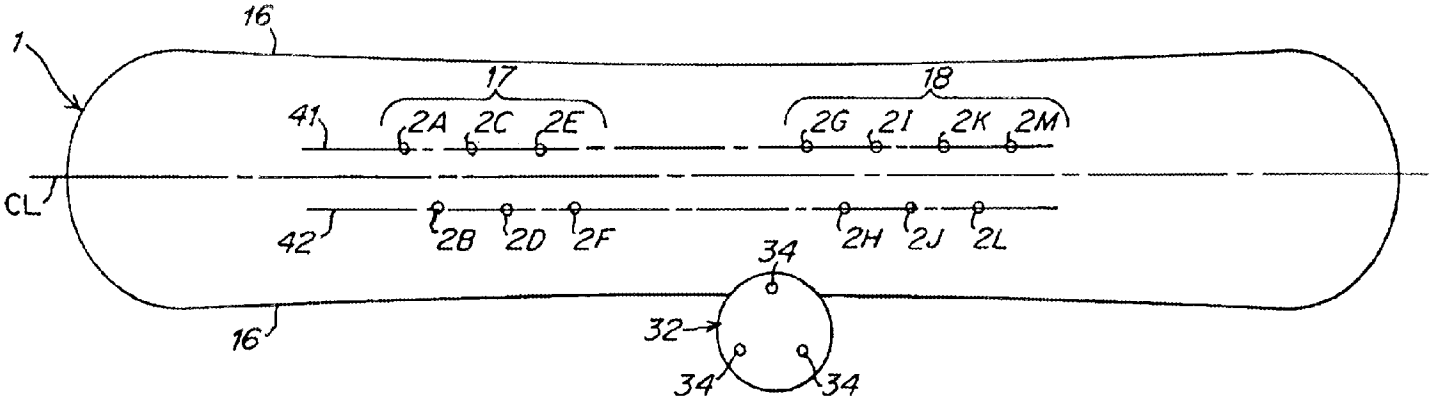
FIG. 5 is a top view of a snowboard having an attachment feature pattern according to one embodiment of the invention and a compatible hold down disk.

One aspect of the invention illustrated in FIG. 5 is a gliding board, such as a snowboard, having a tip and a tail and a plurality of attachment features arranged on the board along first and second longitudinal rows to form a plurality of triangular patterns. Each triangular pattern is formed by a first attachment feature on the first or second row, and second and third attachment features on the other row. Thus, the attachment features may be arranged in a kind of zig-zag pattern down the two rows to form adjacent triangular patterns of attachment features.

According to this aspect of the invention, attachment features may be arranged along two longitudinal rows like a typical 4×4 pattern, but unlike the 4×4 pattern, each binding mounting position may be provided by two or three attachment features instead of four, thereby reducing the number of attachment features needed for a given number of binding mounting positions. In addition, adjacent binding mounting positions may share all but one attachment feature, reducing the number of attachment features needed to provide a given number of binding mounting positions, or increasing the number of binding mounting positions provided by a given number of attachment features as compared to the 4×4 or 3D® patterns.

Such an arrangement may also provide a wider range over which a binding may be mounted to a board for a given number of attachment features. For example, assuming a same increment of adjustment between adjacent binding mounting positions, an attachment feature pattern having six attachment features according to this illustrative embodiment may provide four binding mounting positions over a range equal to three times the increment of adjustment. As another example, assuming a same increment of adjustment between adjacent binding mounting positions, an attachment feature pattern having six attachment features may provide four binding mounting positions over a range equal to four times the increment of adjustment. In a 4×4 pattern having six attachment features, two binding mounting positions are provided over a range equal to the increment of adjustment. Thus, according to this illustrative embodiment, more binding mounting positions distributed over a wider range of adjustment may be provided using a same number of attachment features. The same is true when compared to the 3D® pattern. For example, a 3D® pattern having seven attachment features provides three binding mounting positions over a range of three times the increment of adjustment. In contrast, as will be appreciated from the discussion below concerning this illustrative embodiment of the invention, five or six binding mounting positions may be provided by seven attachment features over a range of four or five times the increment of adjustment, depending on the number of attachment features providing each binding mounting position.

According to another aspect of the invention, the attachment features are arranged along first and second rows generally extending in the tip to tail direction of the board, and are evenly spaced along the rows. The rows are longitudinally offset so that no attachment feature in the first row lies on a same lateral line, which is perpendicular to the longitudinal rows, as an attachment feature in the second row. This is in contrast to a 4×4 pattern in which pairs of inserts are located on a same lateral line. By longitudinally offsetting the rows of attachment features in this illustrative embodiment, triangular patterns of inserts may be used to secure a binding to the board rather than square patterns in the 4×4 pattern. The triangular patterns may be any non-right triangle, including equilateral, isosceles, etc. Since triangular patterns of attachment features are used to provide binding mounting positions, the number of attachment features needed for a given number of binding mounting positions may be reduced and/or the number of binding mounting positions provided by a given number of attachment features may be increased.

According to another illustrative embodiment of the invention, the plurality of attachment features is arranged in a pattern so that an increment of adjustment between adjacent mounting positions along the length of the board is less than a minimum distance between any two of the plurality of attachment features. Adjacent binding mounting positions in a 4×4 or 3D® pattern are spaced at a distance approximately equal to the minimum distance between attachment features. For example, it has been found that if metallic inserts are placed in a snowboard closer than a minimum distance, the likelihood of one or more inserts pulling out of the snowboard increases. Thus, in conventional hole patterns, this minimum pull out distance acts as a limit below which the minimum adjustment increment cannot be reduced. Conversely, one embodiment of the invention provides an increment of adjustment between mounting positions that is less than the minimum distance between attachment features.

According to other illustrative embodiments of the invention, the plurality of attachment features is arranged to form 1) at least one non-right triangular pattern of attachment features where one leg of the non-right triangle extends substantially parallel to a tip-to-tail direction on the board, and/or 2) at least one equilateral triangular pattern of attachment features where the equilateral triangular pattern has no leg parallel to an edge-to-edge direction on the board.

According to another illustrative embodiment of the invention, the plurality of attachment features is arranged to form a plurality of adjacent patterns of attachment features where adjacent patterns have centers that are offset on alternate sides of a line extending in a tip-to-tail direction on the board, e.g., a centerline of the board. By offsetting the centers of adjacent patterns on alternate sides of a tip-to-tail line, such as the centerline, the patterns may be more closely spaced, thereby potentially decreasing the increment of adjustment between binding mounting positions located along the tip-to-tail line.

Another illustrative embodiment is directed to a hold down disk to help ensure that a binding mounted to the board can be laterally (i.e., toe edge to heel edge) aligned independently of the attachment feature pattern used, so that a center of a pattern of openings in the hold down disk made to cooperate with the attachment feature patterns on the board is displaced from the center of the disk itself. The pattern of openings may be linear, triangular or other. Thus, if a binding is mounted to a board at a first binding mounting position and the binding is moved to an adjacent mounting position, the disk may be rotated and aligned with the attachment features at the adjacent binding mounting position so that the binding is laterally positioned in the same way as at the first binding mounting position. This feature assists in making adjusting the longitudinal position of a binding on a board, e.g., adjusting a rider's stance width, independent from the lateral adjustment of the binding.

In the illustrative embodiment shown in FIG. 5, the attachment features 2 are arranged on the snowboard 1 in two groups 17 and 18, each group for mounting a different binding to the snowboard 1. A first group 17 includes the attachment features 2A through 2F, and the second group 18 includes the attachment features 2G through 2M. Like the FIG. 1 embodiment, the first group 17 may be used to attach a left foot binding to the snowboard 1, and the second group 18 may be used to attach a right foot binding to the snowboard 1. The attachment features 2 are arranged in a pattern so that groups of three adjacent attachment features 2 are at the vertices of a triangle, where each triangular pattern formed by three adjacent attachment features 2 provides a binding mounting position. Thus, each left and right foot binding may, for example, be mounted via a hold down disk 32 or otherwise to the snowboard 1 at a selected mounting position with holes 34 arranged in a triangular pattern to cooperate with triangular patterns of attachment features 2 on the board 1. A width of a rider's stance on the snowboard 1 may be adjusted, e.g., narrowed or widened, by adjusting the mounting position of either or both the left and right foot bindings using different triangular patterns of attachment features 2 to secure the bindings to the snowboard 1.

In this illustrative embodiment, the attachment features 2 are arranged along two longitudinal lines 41 and 42. In the embodiment shown, the longitudinal lines 41 and 42 are parallel to and equally spaced from a centerline CL. However, it should be appreciated that the present invention is not limited in this respect, as the lines 41 and 42 alternatively may be transverse to the centerline CL, may be non-parallel relative to the centerline CL, and/or may not be equally spaced from the centerline CL. The centerline CL is an imaginary line that extends in a longitudinal, or tip-to-tail, direction of the snowboard 1 and is equally spaced from the edges of the board.

Several aspects of the invention described above are illustrated in FIG. 5. For example, the number of binding mounting positions provided by the attachment features in the first group 17 (four positions) is equal to two less than the number of attachment features (six features). Further, a majority of the attachment features in the second group 18 is positioned along one row, e.g., the line 41. As described in more detail below and in accordance with other aspects of the invention previously described, the attachment features are positioned within 19 mm of the centerline CL and are positioned within a rectangular area having a width of no more than 38 mm. In accordance with other aspects of the invention, the disk 32 may also be arranged so that it covers three attachment features when mounted to the board, and additional binding mounting positions may be added with the addition of a single attachment feature 2. Further, non-adjacent binding mounting positions share at least one attachment feature.

According to another aspect of the invention, the rows of attachment features 2 along the lines 41 and 42 may be offset so that no attachment feature 1 in a first row, e.g., on the line 41, is positioned on a same lateral line, perpendicular to the rows, as an attachment feature 2 in the other row, e.g., on the line 42. This arrangement is in contrast to 4×4 and 3D® patterns in which at least some inserts on opposite rows are positioned on a same lateral line perpendicular to the rows. The offset of the rows of attachment features 2 in this illustrative embodiment results in the attachment features 2 being positioned at the vertices of at least one non-right triangle that is formed by an attachment feature 2 in a first row, e.g., along the line 41, and two adjacent attachment features 2 in the other row, e.g., along the line 42. As used herein, a first attachment feature 2 is "adjacent" a second attachment feature 2 when there is no attachment feature positioned between the first and second attachment features. For example, a non-right triangle, such as an isosceles, equilateral or other non-right triangle, is formed by the attachment feature 2B on the line 42 and the attachment features 2A and 2C on the line 41.

According to another aspect of the invention, the non-right triangle has a leg, or side, that is parallel to the rows of attachment features 2. For example, a side 2A–2C of the triangle formed by the attachment features 2A, 2B and 2C may be parallel to the centerline CL, a side 2B–2D of the triangle formed by the attachment features 2B, 2C and 2D may be parallel to the centerline CL, and so on. In the embodiment wherein the rows are parallel to the centerline CL, each non-right triangle then has a leg that is parallel to the centerline CL, or the tip-to-tail direction, and also has no leg parallel to an edge-to-edge direction that extends approximately perpendicular to the edges 16 of the board 1.

According to yet another aspect of the invention, the rows and the attachment features 2 within a row are spaced so that a plurality of equilateral triangles are created. As a result, at least one of the attachment features 2 may be arranged so that it is equally spaced from its four adjacent attachment features 2. For example, if an equilateral triangle is formed by (i) the attachment features 2A, 2B and 2C, (ii) by the attachment features 2B, 2C and 2D, and (iii) by the attachment features 2C, 2D and 2E, the attachment feature 2C is equally spaced from its four adjacent attachment features 2A, 2B, 2D and 2E.

According to a further aspect of the invention, the rows may be offset by one-half the separation distance between attachment features 2. For example, if the attachment features are separated by a distance of 40 millimeters along the rows, the row of attachment features 2 along the line 41 may be offset by 20 millimeters (to the right in FIG. 5) from those along line 42 so that the attachment feature 2B is longitudinally positioned half way between the attachment features 2A and 2C.

In the illustrative embodiment shown in FIG. 5, all adjacent mounting positions provided by adjacent triangular patterns of attachment features 2 share two common attachment features 2. For example, a mounting position provided by the attachment features 2A, 2B and 2C shares two attachment features 2B and 2C with its adjacent mounting position provided by the features 2B, 2C and 2D. As a result, only a single attachment feature 2 changes when moving between two adjacent mounting positions. Thus, the attachment feature 2 arrangement in this illustrative embodiment allows another binding mounting position to be added at all points in the pattern by adding a single attachment feature 2. For example, another binding mounting position may be added to the first group 17 of attachment features 2 by appropriately adding one more attachment feature 2 to the row on the line 41 to the right of attachment feature 2E, or by adding one more to the row on line 42 to the left of feature 2B.

As described in more detail below, one way of implementing the embodiment of the present invention that provides an increment of adjustment between adjacent mounting positions, i.e., a distance between adjacent binding mounting positions, that is less than the minimum distance between adjacent attachment features 2 is to arrange the attachment features 2 so that the centers of adjacent mounting positions are offset on opposite sides of a tip-to-tail line extending between the attachment features (e.g., the centerline CL as shown in FIG. 5). This is advantageous in that it enables the attachment features 2 to be spaced apart by a relatively long distance (which, for example, may help preserve the strength of the snowboard 1 and reduce a need to reinforce the board near the attachment features 2) while providing binding mounting positions at a relatively shorter incremental distance.

The arrangement of attachment features 2 shown in FIG. 5 also provides an overall range of adjustment, i.e., a total distance over which a binding may be mounted to a snowboard 1, that is greater than 4×4 and 3D® patterns having a same number of attachment features. For example, a 4×4 pattern that provides a same number of mounting positions and total range of adjustment as a pattern shown in FIG. 1 would necessarily require more attachment features 2, since four attachment features 2 are used to mount a binding at each mounting position and two additional attachment features 2 must be added to the pattern for each new mounting position. Reducing the number of attachment features 2 in the snowboard 1 may allow for a lower weight board and/or require less reinforcement of the board near the attachment features 2 to prevent pull-out or other detachment of the features 2 from the snowboard 1.

The first group 17 of attachment features 2 in FIG. 5 includes six attachment features 2, whereas the second group 18 includes seven attachment features 2. However, it should be understood that the first and second groups of attachment features 2 each may include any suitable number of attachment features 2 other than six or seven attachment features 2, e.g., to provide a different range of adjustment for a binding, as the invention is not limited to using any particular number of attachment features 2. In addition, the first and second groups 17 and 18 of attachment features 2 may include a same number of attachment features 2, e.g., six inserts.

In the illustrative embodiment of FIG. 5, the attachment features 2 are arranged along two longitudinal lines 41 and 42. However, this arrangement is not necessary. For example, a first group 17 of attachment features 2 may be arranged along a first pair of approximately parallel lines, and a second group 18 of attachment features 2 may be arranged along a second pair of approximately parallel lines. The first and second pairs of parallel lines may or may not be parallel to each other and/or the centerline CL. Thus, first and second groups 17 and 18 of attachment features 2 may be arranged along lines that are at an angle with respect to each other and/or at an angle with respect to the centerline CL. Further, the snowboard 1 need not include two distinct groups 17 and 18 of attachment features 2, but instead may have a single continuous group of attachment features 2.

Figure 6:
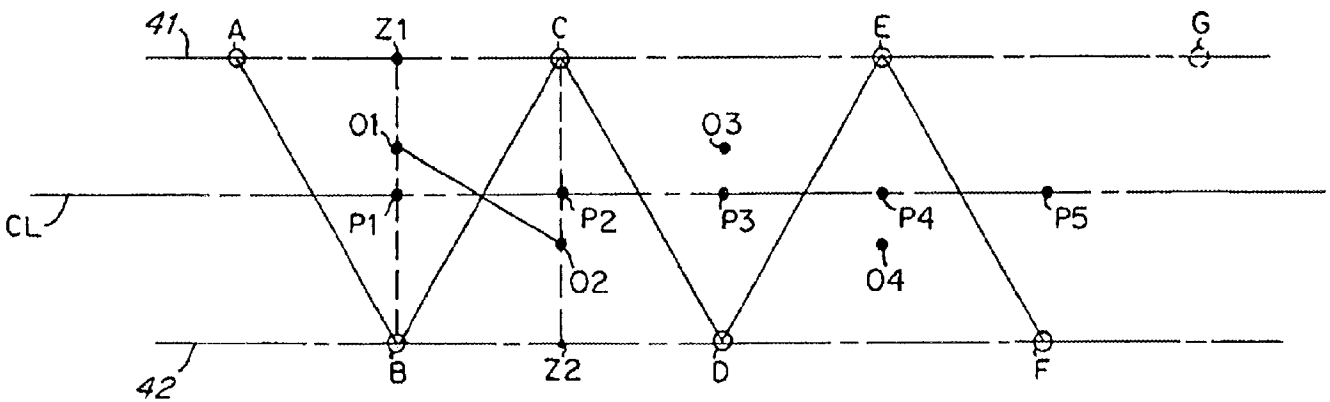
FIG. 6 is a geometrical representation of a portion of the attachment feature pattern in the embodiment shown in FIG. 5.

FIG. 6 shows a more detailed geometrical representation of the first group 17 of attachment features 2 in a specific illustrative embodiment of FIG. 5. In this illustrative embodiment, attachment features 2 are positioned at or near each of the points A–F, which are arranged to form equilateral triangles. Thus, the points A, B and C form an equilateral triangle such that the distances of the lines AB, BC and AC are equal to each other. Similarly, an equilateral triangle is formed by the points B, C and D, and so on. In one embodiment, the distance between points, e.g., the length of lines AB, BC and AC, is 43 millimeters, although other distances between the points may be used. In this illustrative embodiment, groups of three adjacent points, such as points A, B and C, may be used to mount a binding to a snowboard 1.

Each of the centerpoints of the equilateral triangles, e.g., points 01, 02, 03 and 04, is positioned at an equal distance from the vertices of its corresponding equilateral triangle and is offset from the centerline CL. In the illustrative embodiment where the length of each of the sides of each equilateral triangle is 43 millimeters, each of the centerpoints 01, 02, 03 and 04, is positioned at a distance of approximately 24.82 millimeters from each vertex of its corresponding triangle. Thus, the distances between A and 01, B and 01 and C and 01 all equal approximately 24.82 millimeters, and the centerpoint 01 is offset at a distance of approximately 6.2 millimeters above the centerline CL. Similarly, the centerpoint 02 of the equilateral triangle formed by points B, C and D is positioned at an equal distance from its vertices at points B, C and D, and the centerpoint 02 is positioned at a distance of approximately 6.2 millimeters below the centerline CL.

Each of the triangles, i.e., ABC, BCD, CDE, and DEF, may provide a binding mounting position P on the centerline CL. That is, each group of three adjacent attachment features may be used to mount a binding to the snowboard 1 so that the binding is positioned with respect to the corresponding mounting position P along the centerline CL. For example, if a hold down disk 32 is used to mount a binding to the snowboard 1, openings, holes, or other attachment elements in the hold down disk 32 may be suitably arranged so that the hold down disk 32 may be suitably positioned with respect to the centerline CL, e.g., the center of the disk 32 may be positioned at the centerline CL to center the binding in the edge-to-edge direction on the snowboard 1. In this illustrative embodiment, each mounting position P lies on a line that extends from a vertex of the corresponding triangular pattern to a point that bisects an opposite leg of the triangular pattern. For example, the mounting position P1 that corresponds to the triangular pattern formed by attachment features ABC lies at the point where a line extending from the attachment feature 2 at point B to a point Z1 intersects the centerline CL. The point Z1 is equidistant from the points A and C along the line 41. The mounting positions P2, P3 and P4 may be similarly positioned with respect to their corresponding triangular pattern of attachment features 2. In the embodiment where the points A–F are separated by 43 mm from adjacent points, the distance B–P1 and Z1–P1 is equal to approximately 18.6 mm, and the distance between B–Z1 is approximately 37.2 mm. Thus, the centers of the attachment features 2 at points A–F are positioned within 19 mm of the centerline CL, and are positioned within a rectangular area having a width (a dimension measured perpendicular to the centerline CL in this embodiment) of no more than 38 mm.

As mentioned above, the arrangement of attachment features at points A–F shown in FIG. 6 may provide a set of mounting positions P along the length of the snowboard 1 that are separated by a distance, i.e., an increment of adjustment, that is less than a minimum distance between the attachment features 2. For example, in the illustrative embodiment where the attachment features 2 are separated by a minimum distance of 43 millimeters, adjacent mounting positions P along the centerline CL are separated by a distance of approximately 21.5 millimeters. Thus, the attachment feature arrangement shown in FIG. 6 provides a minimum increment of adjustment between mounting positions P that is one-half of the minimum distance between attachment features 2. This feature is provided, at least in part, by the pattern of the attachment features 2 creating triangles having centerpoints 01–04 that are offset from the centerline CL, i.e., the centerpoints of adjacent mounting positions are offset on alternate sides of the centerline CL. Thus, for example, even though the centerpoints 01 and 02 are separated by a distance 01–02 equal to the minimum distance between attachment features 2, the distance between mounting positions P1–P2 is equal to a shorter distance, i.e., a longitudinal component of the line 01–02 that is parallel to the centerline CL.

In some cases, it may be desirable to provide a relatively small increment of adjustment between binding mounting positions P, because this may provide a rider with the ability to mount a binding at an ideal, or near ideal, tip-to-tail position on the snowboard 1. With prior attachment position arrangements, the increment of adjustment between binding mounting positions P was limited by a minimum distance between attachment features 2, which distance was constrained by certain physical characteristics of the snowboard 1. For example, attachment features 2 have not been fixed within a snowboard 1 closer than certain distances, e.g., closer than 25 millimeters, out of a concern that doing so could create a weakness in the snowboard 1 near the closely spaced attachment features 2. Thus, by providing an increment of adjustment that is less than the minimum distance between attachment features, an attachment feature arrangement in accordance with one embodiment of the invention can provide relatively small increments of adjustment between binding mounting positions P while maintaining a relatively larger distance between attachment features 2 on the snowboard 1. However, it should be understood that this aspect of the invention is not limited to the specific attachment feature pattern of FIG. 2, as other attachment feature patterns (e.g., others in which the centers of binding mounting patterns are offset on alternate sides of a longitudinal line along the board) can be used to achieve this result.

Another aspect of the present invention illustrated by the attachment feature pattern shown in FIG. 6 is that an additional binding mounting position P may be added to all positions in the pattern by adding a single additional attachment feature 2. For example, by adding an attachment feature at the point G in FIG. 6, an additional binding mounting position P5 is added. This is not the case with 4×4 and 3D® patterns. In the case of the 4×4 pattern, four inserts are used to mount a binding at a mounting position, so that two additional inserts must be added to an existing pattern to provide an additional mounting position. In the case of the 3D® pattern, while in some cases an additional binding mounting position may be added by providing a single additional insert, this is not true for all positions in the pattern. That is, in some positions in the pattern, two additional inserts must be added to provide an additional mounting position.

It should also be understood that the aspect of the invention where only one attachment feature may be added to provide an additional mounting position is not limited to the specific pattern shown in FIG. 6, as other attachment feature patterns, such as that shown in FIG. 1, can be used that achieve this result.

Figure 7:
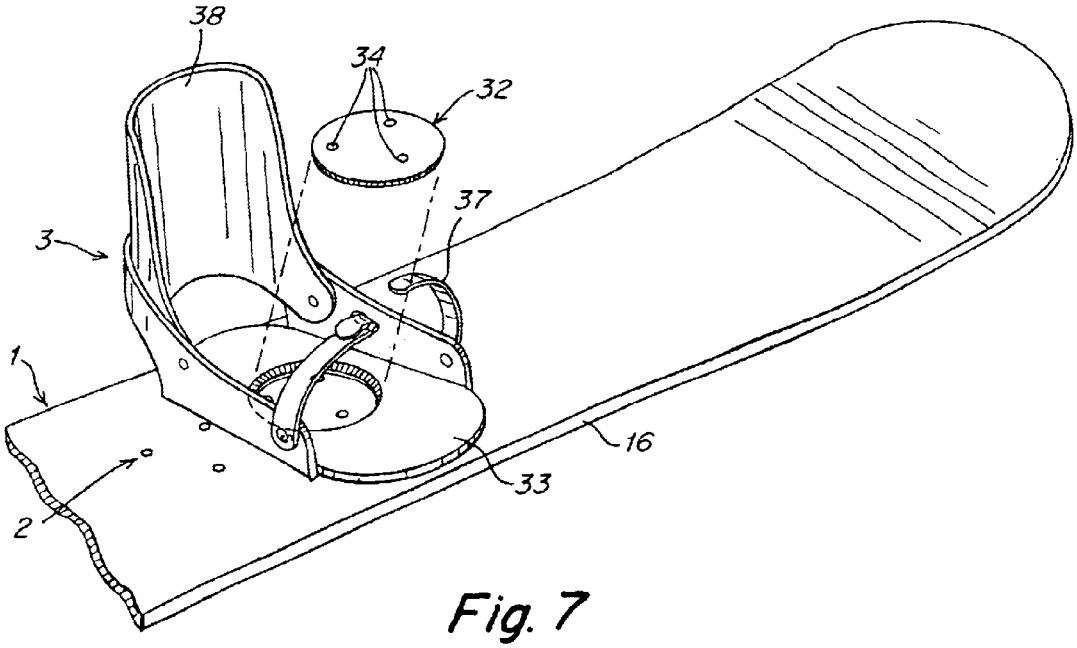
FIG. 7 is a perspective view of a binding mounted, using a hold down disk, to a snowboard with the attachment feature pattern of FIG. 5.

As discussed above, a binding 3 may be attached to the snowboard 1 as shown in FIG. 7 using a hold down disk 32 that has three holes 34 positioned at the vertices of a triangle and arranged to overlie attachment features 2 in the snowboard 1. As in FIG. 3 above, the binding 3 is shown as a conventional tray binding with a toe strap 37 and highback 38, but the present invention is not limited to a binding 3 including these and/or any other particular elements, as the binding 3 may be any type of binding, such as a strap binding, step-in binding, plate binding, or any other type of device used to attach a rider's foot to a snowboard 1, whether the rider is wearing soft or hard boots, or other footwear, as the invention is not limited to use with any particular type of binding 3.

When mounting the binding 3 to the snowboard 1, three holes 34 in the hold down disk 32 may be aligned with three corresponding attachment features 2 at a suitable mounting position, and the disk 32 secured to the snowboard 1 at the mounting position, e.g., by engaging screws with the three attachment features 2. The hold down disk 32 may engage with an opening formed in the baseplate 33 of the binding 3, and have any other suitable features to perform any of the functions described above, such as engage with the opening in the baseplate 33 to secure the binding 3 to the snowboard 1 and/or prevent rotation of the baseplate 33 relative to the hold down disk.

Figure 8:
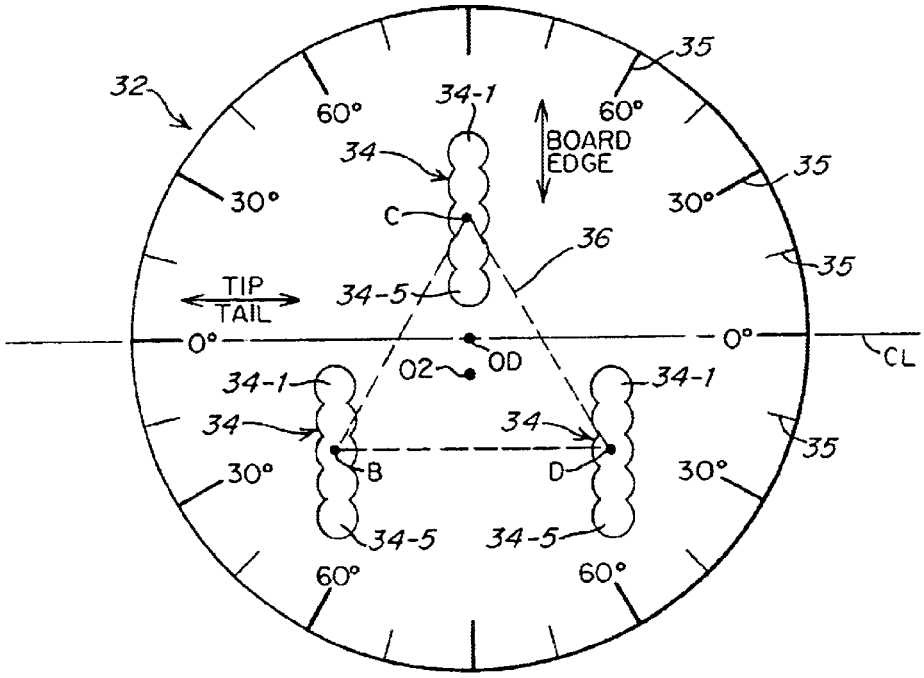
FIG. 8 is a top view of a hold down disk according to one embodiment of the invention that may, for example, be used with the attachment feature pattern shown in FIG. 5.

FIG. 8 shows one illustrative embodiment of a hold down disk 32 in accordance with aspects of the invention. This hold down disk 32 is specially adapted for use with the attachment feature patterns discussed above in connection with FIGS. 5 and 6 and has three through holes 34 to receive fasteners (e.g., screws) to attach to the attachment feature 2. In this illustrative embodiment, each hole 34 has scalloped portions to provide five different adjustment positions, e.g., so that the hold down disk 32 and corresponding binding 3 may be adjusted in position in an edge-to-edge direction on the snowboard 1. That is, in this embodiment, each hole 34 provides for five different adjustment positions (e.g., spaced at 5 millimeter increments) at which a screw may pass through the hole 34 and secure the disk 32 to the snowboard 1. Of course, the aspects of the invention directed to a new hold down disk 32 are not limited to one using holes 34 with five scalloped adjustment positions, as each hole 34 may provide only a single adjustment position, may be replaced by multiple spaced holes each providing a single adjustment position, may be formed as an oblong hole not having any discrete adjustment positions, or may include different numbers of adjustment positions.

The adjustment positions for the holes 34 in the FIG. 8 embodiment form five equally sized triangles, including a central triangle 36 and four other triangles formed by corresponding scalloped portions of the holes 34. The central triangle 36 provides a central adjustment position by which the center OD of the disk 32 may be positioned nearest a reference line, such as the centerline CL on the snowboard 1. Thus, for example, when the disk 32 is mounted to the snowboard 1 using the central triangle 36, the disk 32 may be positioned nearer the centerline CL (e.g., at the centerline) as compared to other triangles provided by the holes 34. In this embodiment, one central triangle 36 is provided, but the holes 34 may provide two or more central triangles 36, e.g., two adjustment positions that position the disk 32 at an equal distance from the centerline CL. Also, in the embodiment shown, the triangles, including the central triangle 36, are equilateral triangles, but the invention is not so limited. Rather, the triangles may be any type of triangle suitably arranged to cooperate with an attachment feature pattern on a snowboard 1.

One aspect of the invention illustrated in the embodiment of FIG. 8 is that the hold down disk 32 has at least three openings (e.g., the holes 34), that form a triangle, e.g., the triangle 36, and are arranged so that no leg of the triangle is perpendicular to a tip-to-tail axis of the disk 32. This type of arrangement may cooperate with a pattern in which the attachment features are arranged in a triangle with no leg perpendicular to the tip-to-tail axis of the board. The tip-to-tail axis of the disk 32 is, in this illustrative embodiment, indicated by the tip-tail marking on the disk 32, and is arranged to lie in the tip-to-tail direction of the snowboard 1 when the disk 32 is mounted to the attachment feature pattern in the snowboard 1. It should be appreciated that the present invention is not limited to a disk 32 that includes markings for the tip-to-tail axis, as the same information may be otherwise indicated, e.g., by edge-edge markings on the disk 32, or the disk can be devoid of any such markings at all.

Another aspect of the invention illustrated in the FIG. 8 embodiment is that the disk 32 has at least three openings 34 that form a triangle, e.g., the central triangle 36, and are arranged in the disk 32 so that a line between two openings and extending parallel to the tip-to-tail axis is as long as any other leg of the triangle. This is true, for example, of a leg of the triangle 36 that extends between the points B and D in FIG. 8. This type of arrangement may cooperate with an attachment feature pattern in the snowboard in which the attachment features form at least one triangle with a leg parallel to the tip-to-tail axis that is as long as any other leg of the triangle.

Another aspect of the present invention illustrated by the embodiment of FIG. 8 is that the hold down disk 32 has at least three openings 34 that form at least one central triangle 36 having a center (at 02 in this embodiment since the vertices of the central triangle 36 are shown aligned with the attachment feature pattern BCD from FIG. 6) that is offset from the center OD of the hold down disk 32. That is, although several triangular patterns may be formed by the openings 34 for different adjustment positions, at least one central triangle, (e.g., the triangle 36), has a center (a point equidistant from the vertices of the triangle 36) that is spaced from the center OD of the disk 32. A hold down disk incorporating this aspect of the invention may be used to cooperate with a pattern of attachment features in a snowboard 1 in which the centers of adjacent binding mounting positions are offset on alternate sides of a tip-to-tail line, such as a centerline, on the snowboard 1 by the same amount that the center of the center triangle is offset from the center OD of the disk. Offsetting the center of the central triangle 36 from the center OD of the disk 32 in this manner allows the disk 32 to be uniformly positioned in the edge-to-edge direction independently of the longitudinal position of the disk 32 on the snowboard 1, i.e., regardless of which mounting position is used on the snowboard 1.

For example, in one embodiment, the center of the central triangle 36 is offset from the center OD of the disk 32 by an amount equal to the offset of the centerpoint 02 of the triangle BCD in FIG. 6. As a result, when the openings 34 in the disk 32 that form the central triangle 36 are secured to the attachment features 2 at the points B, C and D, the center of the central triangle 36 overlies the centerpoint 02 of the triangle BCD and the center OD of the disk 32 is positioned at the centerline CL on the snowboard 1. Of course, any adjustment positions of the holes 34 may be used, and may correspond with any triangular pattern of attachment features 2 on the snowboard 1 in FIGS. 5 and 6 to customize the position of the binding 3. In the embodiment shown in FIG. 8, the adjustment positions on either side of the central adjustment position are equally spaced from the central adjustment position (e.g., the upper mounting position 34-1 is the same distance from the central position (at BCD) as the lowermost position 34-5). As a result, the disk 32 may be used to adjust the binding 3 from one mounting position P (see FIG. 6) to another adjacent mounting position P without altering the edge-to-edge position of the binding 3. Thus, the longitudinal position of the binding 3 may be adjusted independently of the edge-to-edge position by using the same corresponding adjustment positions of the holes 34 at the two mounting positions. For example, if the binding 3 is mounted to the snowboard 1 at the mounting position P2 using the adjustment position closest the toe edge (the uppermost adjustment position 34-1 of the holes 34 as shown in FIG. 8), the disk 32 may be removed, rotated 180 degrees and secured to the attachment features 2 at the points C, D and E using the adjustment position closest to the toe edge of the now rotated disk 32 (i.e., the adjustment position formerly closest to the heel edge as shown in FIG. 5). This feature can be useful when a rider would like to adjust stance width on a snowboard 1 without making any adjustment in the edge-to-edge position of a binding 3. Thus, the rider need only remember the adjustment position used at a first mounting position, e.g., the top adjustment position of the holes 34, move the disk 32 to the new mounting position and reattach the disk 32 and binding 3 using the same corresponding adjustment position, e.g., the top adjustment position, regardless of whether the disk 32 is rotated to mount the binding 3 at the new position.

Thus, offsetting the centerpoint of the central adjustment position of the holes 34 from the center OD of the disk 32 and spacing adjustment positions uniformly from the central adjustment position, e.g., at 5 millimeter increments, may provide advantages over other hole 34 arrangements. If the central adjustment position for the holes 34 were positioned so that the center OD of the disk 32 was at the centerpoint 02 of the triangular pattern BCD in FIG. 2, this arrangement might not allow a binding 3 to be positioned on the snowboard 1 in a predictable way, especially when the disk 32 is turned 180 degrees so that the binding may be adjusted from one mounting position P to another adjacent mounting position P. For example, if the centerpoint (at 02) of the central adjustment position for the holes 34 is positioned at the center OD of the disk 32, when the disk 32 is rotated and engaged at the adjacent triangular pattern CDE, the center OD of the disk 32 would be positioned at the centerpoint 03, which would result in the binding 3 being offset in an edge-to-edge direction by an amount equaling the offset of the centerpoints 02, 03 from the centerline CL. If the holes 34 have slots or otherwise provide multiple adjustment positions, this offset may be compensated for by using different adjustment positions of the holes 34 for the different mounting positions P. However, this may not be ideal since an adjustment in a rider's stance width on the snowboard 1 would require compensation in the edge-to-edge direction as well as the tip-to-tail direction. Instead, an adjustment in stance width should preferably be only dependent on which adjustment position of the holes 34 is used to mount the bindings 3. That is, for example, if a binding 3 is moved from one mounting position to another mounting position, the edge-to-edge position of the binding 3 preferably should not change if the same, corresponding adjustment position for the holes 34 is used at both mounting positions.

While offsetting the centerpoint of the central adjustment position for the holes 34 from the center of the disk is advantageous in an embodiment where the centerpoint of the binding mounting position is offset from a centerline of the snowboard, use of such offsetting and other features of the FIG. 8 embodiment are not required with other aspects of the invention described above. In addition, it is not necessary to employ holes 34 that provide a central adjustment position on the disk that locates the center OD of the disk 32 at a tip-to-tail line on the board, such as the centerline CL. In addition, the adjustment positions may be equally spaced from a central adjustment position as in the illustrative embodiment of FIG. 8, or unequally spaced from each other and/or from the central adjustment position. Further, in this embodiment, the holes 34 are extended in a direction transverse to the tip-to-tail direction to allow the disk 32 to be positioned in a lateral toe-to-heel edge direction on the snowboard 1. However, the holes 34 may be arranged in other directions, e.g., to provide adjustment of the disk 32 in a longitudinal direction along the snowboard 1, or as discussed above only a single position can be provided at each vertex.

In the embodiment shown in FIG. 8, the disk 32 includes reference features, including angle indication marks 35, to provide an indication of the orientation of the binding 3 relative to the snowboard 1 or the disk 32. In FIG. 4, the angle indication marks 35 are in increments of 15° with the 0°, 30° and 60° marks being labeled. The angle indication marks 35 may be provided at a finer or more coarse scale and/or may also provide additional angle indication marks, such as one for the 45° mark. Also, the angle indication marks may be positioned in any suitable way on the disk 32, e.g., the 0° marks may be changed to 90° marks and the other marks 35 adjusted accordingly. The disk 32 may also include indicators showing the tip-to-tail direction, e.g., such as a double-headed arrow and text indicator extending between the tip-and-tail marks (e.g., the 0°—0° marks), and/or an indicator showing the approximate location of the edges 16 of the snowboard 1. These additional indicators may provide an aid to properly positioning the disk 32 on a snowboard 1. The angle indication marks 35 may be formed permanently in the disk 32, such as by molding the marks 35 in the disk 32, or may be applied to the disk 32, e.g., on a sticker or other label adhered to the disk 32. The invention is not limited to these specific marking features, as any suitable indication indicia will do. In addition, the angle indication marks 35 or other indicators on the disk 32 may be omitted from some embodiments.

Figure 9:
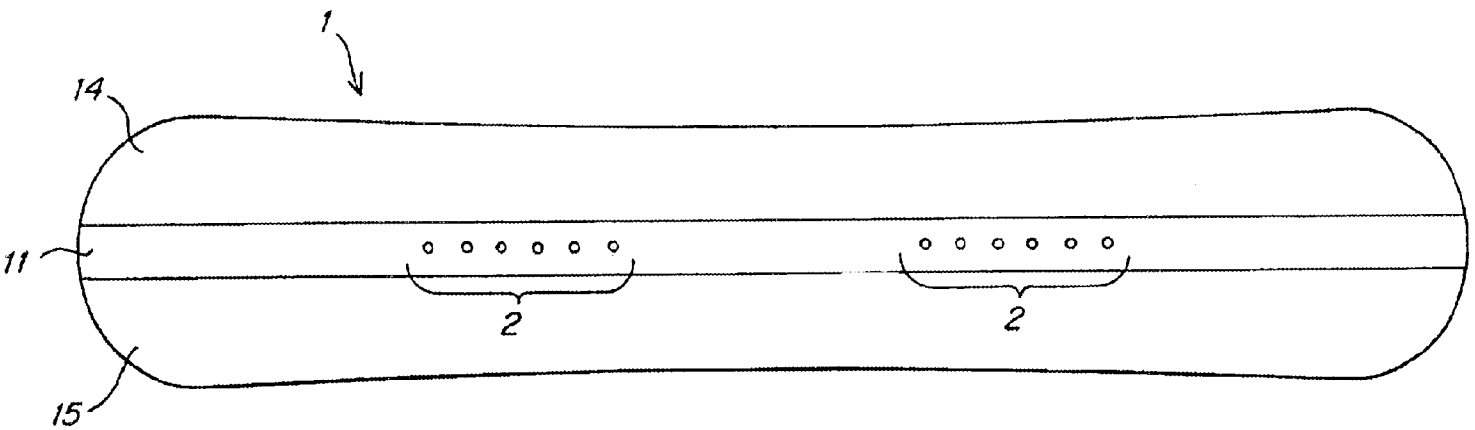
FIG. 9 is a schematic diagram of a snowboard having reinforcement strips according to an embodiment of the invention.

In another aspect of the invention, attachment feature arrangements may provide for a smaller reinforced area on the board where attachment features are positioned. FIG. 9 illustrates an embodiment in accordance with an aspect of the invention employed in a snowboard 1 having the attachment feature pattern shown in FIG. 1. In this illustrative embodiment, the snowboard 1 includes a reinforcement or high-strength strip 11 that runs longitudinally along the snowboard 1. The attachment features 2 may be fixed in the snowboard 1 within or near the reinforcement strip 11. The snowboard 1 may also include lower strength or filler strips 14 and 15 that may have a lower strength than the reinforcement strip 11, as these filler strips are not used to anchor the attachment features 2 to the snowboard 1. Thus, the filler strips 14 and 15 may be made of lighter and/or less expensive material. The strips 11, 14 and 15 may be formed as part of a core of the snowboard 1, e.g., the reinforcement strip 11 may include hardwood strips attached to lighter weight and lower strength filler strips 14 and 15, which may be made of balsa wood. The strips 11, 14 and 15 may be attached together and fashioned to form the core of the snowboard 1 around which other portions of the snowboard 1, such as the base, side edges and top surface, are formed in any suitable manner.

The reinforcement strip 11 may also be incorporated into the snowboard 1 in other ways. For example, the reinforcement strip 11 may include higher strength fiber or resin materials to reinforce areas around the attachment features 2. In addition, the reinforcing strip 11 need not extend along the entire length of the snowboard 1. Instead, the reinforcing strip 11 may be formed only locally around each attachment feature 2 or each group of attachment features 2.

The aspect of the invention described above in connection with FIG. 9 is not limited to the attachment feature 2 arrangement shown in FIG. 1. Instead, reinforcement strips may be provided in the snowboard 1 for attachment features 2 arranged in any desired pattern, such as those shown in FIG. 5, in a typical 4×4 pattern, in a typical 3D® pattern or any other. Thus, the reinforcement strip 11 may be arranged to have different properties and be positioned within the snowboard 1 depending on the attachment feature pattern used.

Figure 10:
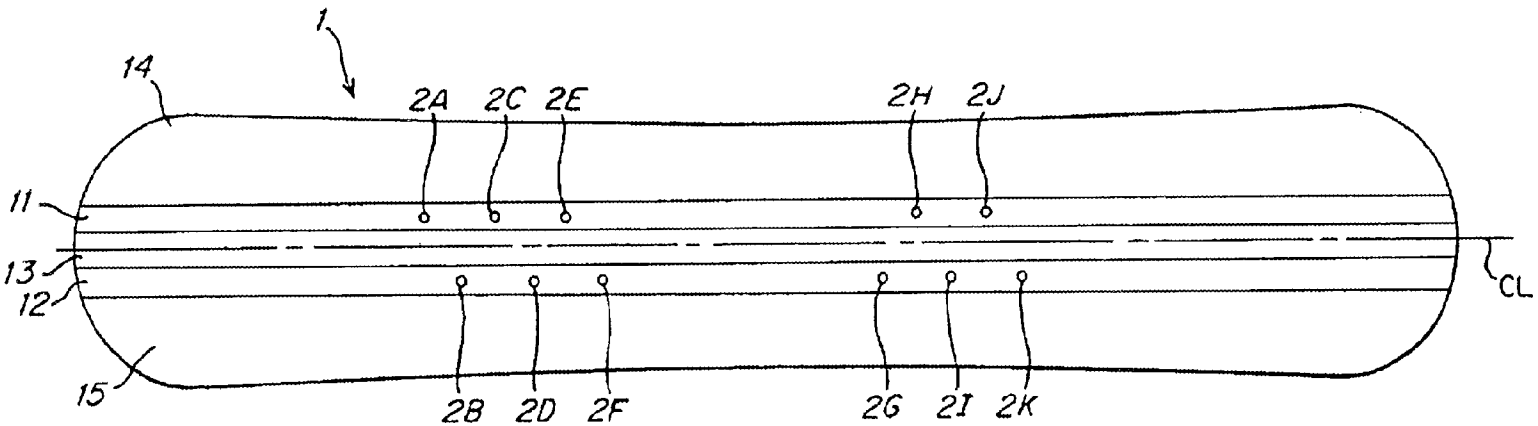
FIG. 10 is a schematic diagram of a snowboard having reinforcement strips according to an alternate embodiment of the invention.

FIG. 10 illustrates an embodiment of the invention wherein the pattern of FIG. 5 is employed in a snowboard 1 having variable strength at different positions of the snowboard 1. In this illustrative embodiment, the snowboard 1 includes a pair of reinforcement or high-strength strips 11 and 12 that run longitudinally along the snowboard 1. Attachment features 2 may be fixed in the snowboard 1 within or near the reinforcement strips 11 and 12. The snowboard 1 may also include lower strength or filler strips 13, 14 and 15 that may have a lower strength than the reinforcement strips 11 and 12, as these filler strips are not used to anchor the attachment features 2 to the snowboard 1. The strips 11–15 may be formed as part of a core of the snowboard 1, e.g., the reinforcement strips 11 and 12 may include hardwood strips attached to lighter weight and lower strength filler strips 13–15, which may be made of balsa wood. The strips 11–15 may be attached together and fashioned to form the core of the snowboard 1.

Figure 11:
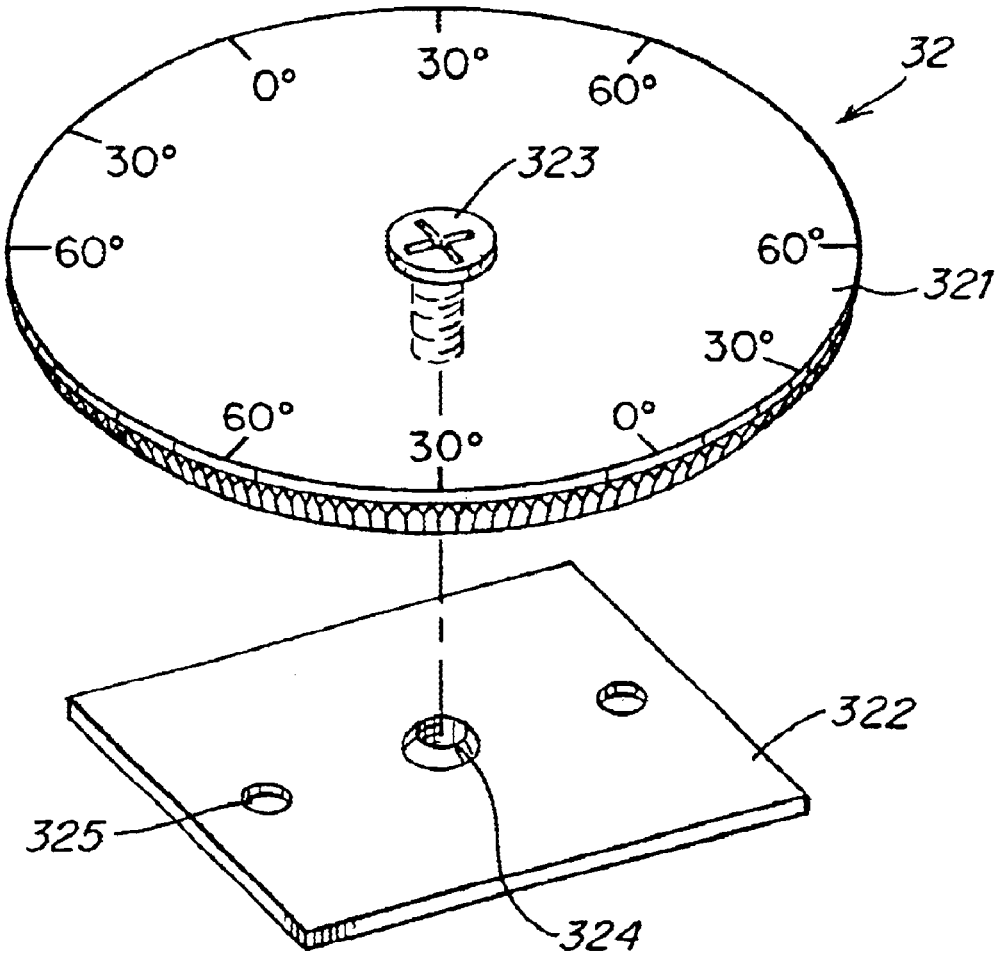
FIG. 11 is a perspective view of a hold down disk having a mounting plate in accordance with an illustrative embodiment of the invention.

Several aspects of the invention discussed above relate to an attachment feature pattern for mounting a binding to a snowboard 1. These aspects of the invention are not limited in how the attachment features 2 are used to mount a binding 3 to the snowboard 1. For example, FIG. 11 shows an illustrative embodiment of a hold down disk 32 having a mounting plate 322. In this embodiment, the mounting plate 322 is attached to a snowboard 1, such as by using screws (not shown) that extend through holes 325 in the plate 322 and engage with attachment features 2 in the snowboard 1. A disk 321 may be attached to the mounting plate 322 by a screw 323 that engages with a threaded hole 324 in the mounting plate 322. Engaging the screw 323 with the threaded hole 324 may cause the disk 321 to engage with the mounting plate 322 so that the disk 321 may not freely rotate relative to the plate 322. The mounting plate 322 may also be provided with holes 325 that are oblong or otherwise provide a plurality of adjustment positions on the snowboard 1 in much the same manner as the holes 34 in the disk 32 of FIG. 4 or 8.

It should also be understood that the aspects of the present invention discussed above are not limited to use with snowboards and snowboarding equipment, as the various aspects of the invention may be used with any gliding board or other recreational device, such as skis, snowshoes, wakeboards, and so on.

While the invention has been described in conjunction with specific embodiments thereof, many alternatives, modifications, and variations will be apparent to those skilled in the art. Accordingly, embodiments of the invention as set forth herein are intended to be illustrative, not limiting. Various changes may be made without departing from the spirit and scope of the invention.

What is claimed is:

1. An apparatus comprising:

a snowboard having side edges, a tip-to-tail direction and a center line that extends along a length of the snowboard in the tip-to-tail direction and is equidistant from the side edges;

a snowboard binding that comprises a hold down disk and is mounted to the snowboard; and a plurality of fasteners that mount the hold down disk to the snowboard;

wherein the hold down disk has a center and a disk axis that extends through the center of the hold down disk and overlies or is parallel to the center line of the snowboard, the hold down disk having first and second slots being the only openings in the hold down disk adapted to receive the plurality of fasteners that mount the hold down disk to the snowboard, each of the first and second slots being at least 40 millimeters in length, the hold down disk further comprising, for each of the first and second slots, a plurality of features that define a plurality of discrete adjustment positions at which the fasteners can be received in a common set of holes in the snowboard, so that the hold down disk can receive the fasteners in a plurality of different adjustment positions, wherein the plurality of features for each of the first and second slots defines a plurality of discrete adjustment positions that includes a number of discrete adjustment positions greater than six, wherein the disk axis extends through and is perpendicular to the first and second slots, and wherein at least one fastener is received in one of the first and second slots at the center line of the board.

2. The apparatus of claim 1, wherein the first slot is parallel to the second slot.

3. The apparatus of claim 1, wherein the first and second slots are of equal length.

4. The apparatus of claim 1, wherein the hold down disk has a diameter of approximately 100 millimeters.

5. The apparatus of claim 1, wherein each of the first and second slots has a midpoint along its length, and wherein the disk axis passes through the midpoint of both the first and second slots.

6. The apparatus of claim 1, wherein the plurality of features that define a plurality of discrete adjustment positions at which the fasteners can be received comprises a plurality of scalloped portions of the first and second slots.

7. The apparatus of claim 1, wherein each of the first and second slots has an end and a mid-section disposed between the ends, and wherein the plurality of features for each of the first and second slots includes features disposed in the mid-section of the slot so that at least one of the plurality of discrete adjustment positions corresponds to the fastener being received in the mid-section of the slot.

8. A snowboard binding comprising:

a snowboard binding base adapted to receive and secure a rider's boot to a snowboard, the snowboard binding base having an opening;

at least one snowboard binding strap, attached to the binding base, adapted to extend over the rider's boot and secure the rider's boot to the binding base; and a snowboard binding hold down disk for being received in the binding base opening and attaching the snowboard binding base to a snowboard, the hold down disk having angle indication marks that indicate an orientation of the snowboard binding base relative to the hold down disk, the angle indication marks including first and second zero degree angle indication marks, the hold down disk having an axis that extends through the first and second zero degree angle indication marks;

the hold down disk further comprising first and second slots adapted to receive fasteners to attach the hold down disk to the snowboard, wherein the axis passes through the first and second slots, wherein the first slot is parallel to the second slot, the first and second slots are of equal length, and each of the first and second slots is at least 40 millimeters in length, wherein the first and second slots each extends substantially perpendicular to the axis that passes through the first and second zero degree angle indication marks, and wherein the first and second slots are the only openings in the hold down disk adapted to receive fasteners to attach the hold down disk to the snowboard;

the hold down disk further comprising, for each of the first and second slots, a plurality of features that define a plurality of discrete adjustment positions at which the fasteners can be received for a common set of holes in the snowboard, wherein the plurality of features for each of the first and second slots defines a plurality of discrete adjustment positions that includes a number of discrete adjustment positions greater than six.

9. The apparatus of claim 8, wherein the hold down disk has a diameter of about 100 millimeters.

10. The apparatus of claim 8, further comprising a snowboard, wherein the snowboard binding base is mounted to the snowboard via the hold down disk, wherein the snowboard has side edges, a tip-to-tail direction and a center line that extends along a length of the snowboard in the tip-to-tail direction and is equidistant from the side edges, and wherein the hold down disk is mounted to the snowboard so that the axis overlies or is parallel to the center line of the snowboard.

11. The apparatus of claim 8 wherein each of the first and second slots has an end and a mid-section disposed between the ends, and wherein the plurality of features for each of the first and second slots includes features disposed in the mid-section of the slot so that at least one of the plurality of discrete adjustment positions corresponds to the fastener being received in the mid-section of the slot.

* * * * *